US005308916A

United States Patent [19]

Murata et al.

[11] Patent Number: 5,308,916

[45] Date of Patent: May 3, 1994

[54] ELECTRONIC STRINGED INSTRUMENT WITH DIGITAL SAMPLING FUNCTION

[75] Inventors: Yoshiyuki Murata, Ome; Hajime Manabe, Higashiyamoto, both of Japan

[73] Assignee: Casio Computer Co., Ltd., Tokyo, Japan

[21] Appl. No.: 629,594

[22] Filed: Dec. 18, 1990

[30] Foreign Application Priority Data

Dec. 20, 1989 [JP] Japan ..... 1-328390

[51] Int. Cl.[5] ..... G10H 7/00

[52] U.S. Cl. ..... 84/603; 84/726

[58] Field of Search ..... 84/723, 725, 726, 731, 84/735, 736-738, 741, 622-625, DIG. 9, 603-607

[56] References Cited

U.S. PATENT DOCUMENTS

| | | | |
|---|---|---|---|
| 3,911,776 | 10/1975 | Beipel | 84/DIG. 9 |
| 4,233,874 | 11/1980 | Mantani | 84/445 X |
| 4,305,319 | 12/1981 | Linn | 84/633 X |
| 4,316,401 | 2/1982 | Tavel et al. | 84/DIG. 8 |
| 4,622,877 | 11/1986 | Strong | 84/604 |
| 4,633,748 | 1/1987 | Takashima et al. | 84/603 |
| 4,633,749 | 1/1987 | Fujimori et al. | 84/607 |
| 4,655,115 | 4/1987 | Nishimoto | 84/DIG. 10 |
| 4,667,556 | 5/1987 | Hanzawa et al. | 84/603 |
| 4,738,179 | 4/1988 | Hideo | 84/604 |
| 4,757,737 | 7/1988 | Conti | 84/681 |
| 4,779,505 | 10/1988 | Suzuki | 84/622 |
| 4,781,097 | 11/1988 | Uchiyama et al. | 84/DIG. 12 X |
| 4,827,824 | 5/1989 | Minakuchi . | |
| 4,884,486 | 12/1989 | McClish | 84/736 |
| 4,915,001 | 4/1990 | Dillard | 84/600 |
| 4,947,723 | 8/1990 | Kawashima et al. | 84/603 |
| 4,984,495 | 1/1991 | Fujimori | 84/603 |
| 5,010,801 | 4/1991 | Sakashita | 84/735 |
| 5,018,427 | 5/1991 | Uchiyama | 84/603 |
| 5,054,085 | 10/1991 | Meisel et al. | 381/43 |
| 5,086,475 | 2/1992 | Kutaragi et al. | 84/603 |
| 5,136,912 | 8/1992 | Morikawa et al. | 84/603 |
| 5,147,970 | 9/1992 | Obata | 84/603 |

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

An electronic stringed instrument applicable to an electronic guitar, violin etc., picks up string vibrations to produce a direct sound. The direct sound is combined with additional sound which is produced by processing the picked-up signal. The direct sound and the processed sound are controlled according to string vibrations. The picked-up signal is converted into a digital signal which is then processed to produce the processed sound whose characteristic is controlled depending on the amplitude and/or pitch of the picked-up signal.

11 Claims, 19 Drawing Sheets

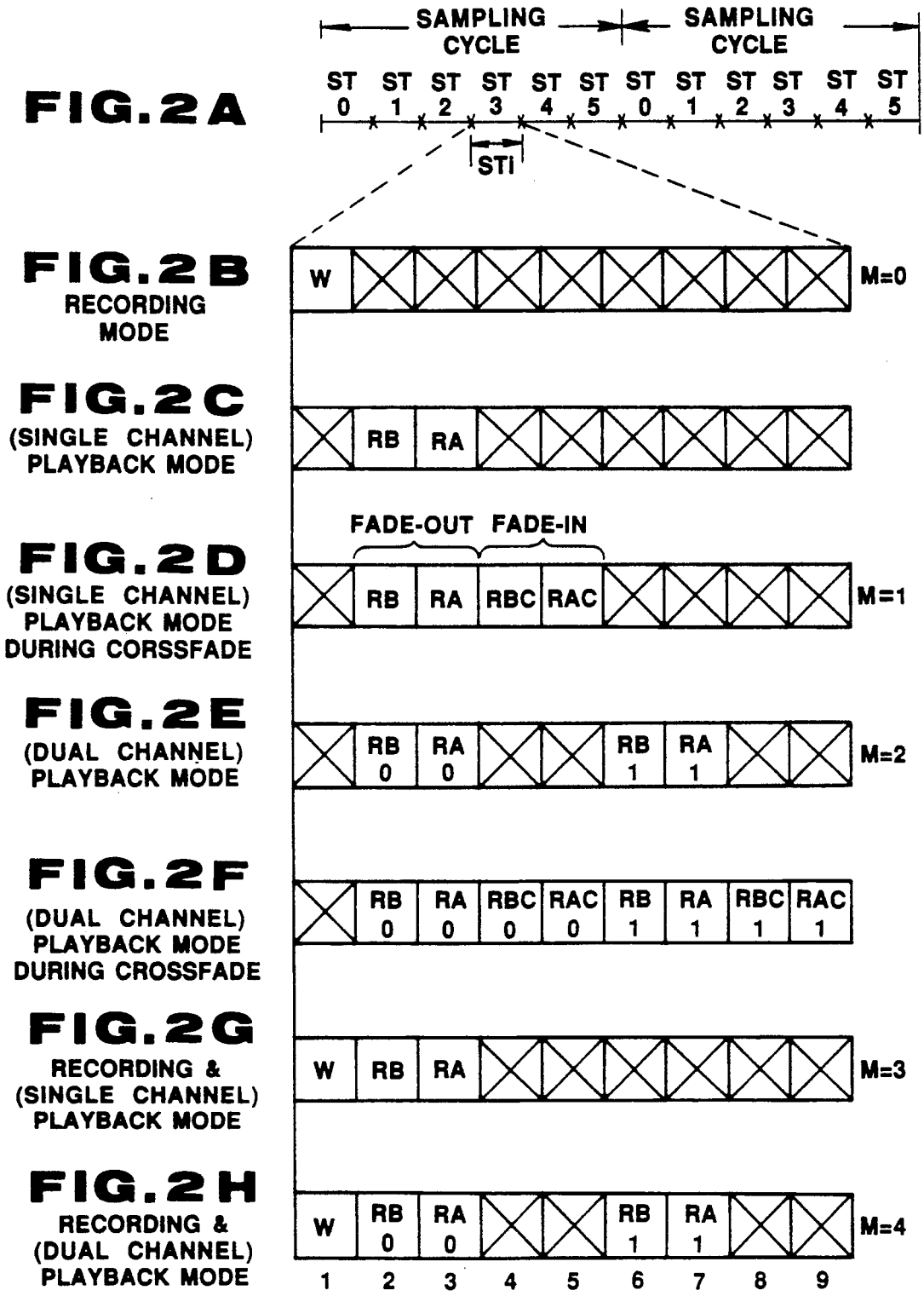
SAMPLING CYCLE
SAMPLING CYCLE
ST 0 ST 1 ST 2 ST 3 ST 4 ST 5 ST 0 ST 1 ST 2 ST 3 ST 4 ST 5
STI
FIG.2A
FIG.2B
RECORDING MODE
W
M=0
FIG.2C
(SINGLE CHANNEL) PLAYBACK MODE
RB
RA
FADE-OUT
FADE-IN
FIG.2D
(SINGLE CHANNEL) PLAYBACK MODE DURING CORSSFADE
RB
RA
RBC
RAC
M=1
FIG.2E
(DUAL CHANNEL) PLAYBACK MODE
RB 0
RA 0
RB 1
RA 1
M=2
FIG.2F
(DUAL CHANNEL) PLAYBACK MODE DURING CROSSFADE
RB 0
RA 0
RBC 0
RAC 0
RB 1
RA 1
RBC 1
RAC 1
FIG.2G
RECORDING & (SINGLE CHANNEL) PLAYBACK MODE
W
RB
RA
M=3
FIG.2H
RECORDING & (DUAL CHANNEL) PLAYBACK MODE
W
RB 0
RA 0
RB 1
RA 1
M=4
1 2 3 4 5 6 7 8 9

LOOPING

APPROACHING

CHANGE PP
POSITION

FIG. 8A NORMAL
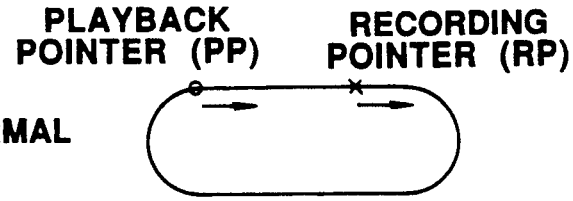
FIG. 8B APPROACHING
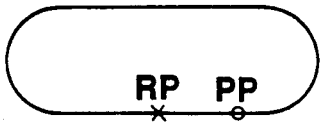
FIG. 8C START OF CROSSFADE
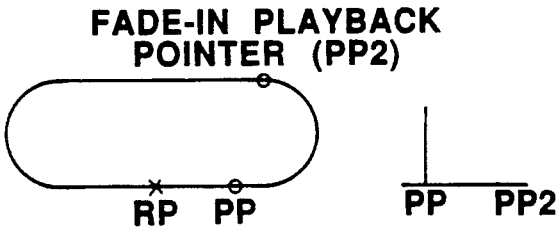
FIG. 8D AMID CROSSFADE
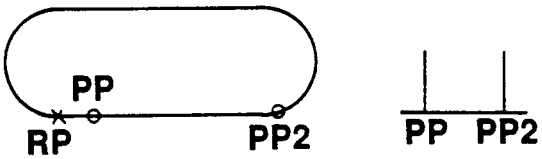
FIG. 8E END OF CROSSFADE
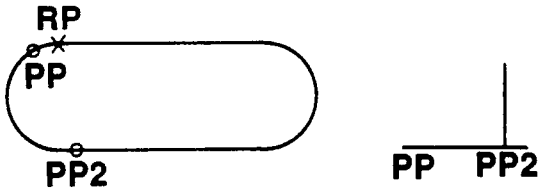
FIG. 8F NORMAL
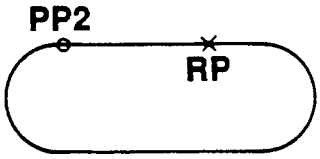

FIG.10A CURRENT ADDRESS 3-3 OUTPUT

FIG.10B RAM ADDRESS SELECTOR 4-6 OUTPUT

FIG.10C FADE-IN SELECTOR 4-2 OUTPUT

FIG.10D RETURN SELECTOR 4-9 OUTPUT

FIG.10E NEXT ADDRESS SELECTOR 4-11 OUTPUT

FIG.10F SELECTOR 9-10 OUTPUT

LU-ADDR=BASE+SIZEX(M-1)
+INT[ ℓn{(PITCH(ST))/C}]

ELECTRONIC STRINGED INSTRUMENT WITH DIGITAL SAMPLING FUNCTION

BACKGROUND OF THE INVENTION

1. Field of the Invention

The present invention relates to electronic stringed instruments applicable to musical instruments such as electronic guitar and violin, and particularly to an electronically operated stringed instrument with sampling function.

2. Description of the Prior Art

An electronic stringed instrument which pickes up string vibrations, extracts level (amplitude) and fundamental period (pitch) of the string vibrations from the picked-up signal and controls an internal or external electronic tone generator based on the extracted results to produce a synthesized sound is known as guitar synthesizer. Despite such electronic function guitar players often prefer guitar sound (direct sound) caused by vibrations of strings themselves. Accordingly, many guitar synthesizers are designed to provide both synthesized and direct sounds.

However, simultaneous sounding and playing of synthesized and direct sounds is rare in practice; play is usually performed selecting and using either synthesized sound or direct sound presumably because of the difference in sound quality between the synthesized sound and the direct sound, and limited controllability of the synthesized sound.

SUMMARY OF THE INVENTION

The invention has been made in view of the foregoing problems.

Therefore, an object of the invention is to provide an electronic stringed instrument capable of controlling a direct sound which meets guitar player's liking and a processed sound which best fits the direct sound, in accordance with player's string operations such as plucking and fingering.

Another object of the invention is to provide an electronic stringed instrument capable of controlling a characteristic of a sound to be outputted in accordance with player's string operations.

Further object of the invention is to provide an electronic musical instrument capable of controlling a sound to be produced from an externally supplied analog signal in accordance with the amplitude level and/or pitch of the analog signal.

To successively achieve the objects, an embodiment of the invention provides an electronic stringed instrument which comprises: pick up means for producing a picked-up signal corresponding to string vibrations; direct sound output means for outputting a picked-up signal from said pick up means as direct sound without any substantial processing; processed sound output means for processing a picked-up signal from said pick up means and for outputting a processed picked-up signal as processed sound concurrently with said direct sound; amplitude level detecting means for detecting amplitude level of a picked-up signal from said pick up means; and control means for controlling a characteristic of said processed sound to be outputted by said processed sound output means based on a detected amplitude level from said amplitude level detecting means.

Another embodiment of the invention provides an electronic stringed instrument comprising: pick up means for producing a picked-up signal corresponding to string vibration; direct sound output means for outputting a picked-up signal from said pick up means as direct sound without any substantial processing; processed sound output means for processing a picked-up signal from said pick up means and for outputting a processed picked-up signal as processed sound concurrently with said direct sound; pitch extracting means for extracting a pitch of said string vibrations from a picked-up signal from said pick up means; and control means for controlling a characteristic of said processed sound to be outputted by said processed sound output means based on an extracted pitch from said pitch extracting means.

In each arrangement, it is a processed sound from the processed sound output means that is combined with the direct sound. The processed sound originates from the same source as that of the direct sound and comprises a picked-up signal corresponding to string vibrations. This assures suitability between the direct sound and the processed sound. Further, concurrent outputting of both the direct sound and the processed sound results in a composite and rich sound with various timbres since the processed sound output means modifies the original picked-up signal to produce the processed sound.

Moreover, each arrangement above serves to control a characteristic of the processed sound based on a parameter of the string vibrations.

More specifically, the former arrangement includes the control means which controls a characteristic of the processed sound based on a detected amplitude level of string vibrations from the amplitude level detecting means. The detected amplitude level may be used to modulate, for example, a pitch of the processed sound. This provides a detune sound effect between the pitch modulated processed sound and pitch unmodulated direct sound.

The latter arrangement includes the control means which controls a characteristic of the processed sound based on an extracted pitch of the string vibrations from the pitch extracting means. The extracted pitch may be used to control, for example, timbre, volume and/or pitch characteristic of the processed sound.

Another embodiment of the invention provides an electronic stringed instrument which comprises: pick up means for producing a picked-up signal corresponding to string vibrations; direct sound output means for outputting a picked-up signal from said pick up means as direct sound without any substantial processing; processed sound output means for processing a picked-up signal from said pick up means and for outputting a processed picked-up signal as processed sound concurrently with said direct sound; amplitude level detecting means for detecting amplitude level of a picked-up signal from said pick up means; and mixing proportion control means for controlling mixing proportion of said direct sound and said processed sound to be outputted by said direct sound output means and said processed sound output means, respectively, based on a detected amplitude level from said amplitude level detecting means.

Still another embodiment of the invention provides an electronic stringed instrument comprising: pick up means for producing a picked-up signal corresponding to string vibrations; direct sound output means for outputting a picked-up signal from said pick up means as direct sound without any substantial processing; processed sound output means for processing a picked-up signal from said pick up means and for outputting a processed picked-up signal as processed sound concurrently with said direct sound; pitch extracting means for extracting a pitch of said string vibrations from a picked-up signal from said pick up means; and mixing proportion control means for controlling mixing proportion of said direct sound and said processed sound to be outputted by said direct sound output means and said processed sound output means, respectively, based on an extracted pitch from said pitch extracting means.

Each of these arrangements can provide a diversified musical sound depending on the player's string operations such as (hard/soft) plucking and (high/low positioned) fingering since the mixing proportion of the processed sound and the direct sound is varied with (a) the detected level of the string vibrations and (b) the extracted pitch of the string vibrations.

A further embodiment of the invention provides an electronic stringed instrument comprising:

pick up means for converting mechanical string vibrations into a corresponding analog picked-up signal; analog-to-digital converter means for successively converting an analog picked-up signal from said pick up means to a corresponding digital picked-up signal; storing means for successively storing a digital picked-up signal from said analog-to-digital converter means; reading means for successively reading a stored digital picked-up signal from said storing means; digital-to-analog converter means for successively converting a read-out digital picked-up signal to from said reading means an analog audio signal; sound output means for outputting an analog audio signal from said digital-to-analog converter means as a sound; amplitude level detecting means for detecting an amplitude level of an analog picked-up signal from said pick up means; and control means for controlling a characteric of a sound to be outputted by said sound output means based on a detected amplitude level from said amplitude level detecting means.

Still another embodiment of the invention provides an electronic stringed instrument comprising: pick up means for converting mechanical string vibrations into a corresponding analog picked-up signal; analog-to-digital converter means for successively converting an analog picked-up signal from said pick up means to a corresponding digital picked-up signal; storing means for successively storing a digital picked-up signal from said analog to digital converter means; reading means for successively reading a stored digital picked-up signal from said storing means; digital-to-analog converter means for successively converting a read-out digital picked-up signal from said reading means to an analog audio signal; sound output means for outputting an analog audio signal from said digital-to-analog converter means as a sound; pitch extracting means for extracting a pitch of an analog picked-up signal from said pick-up signal; and control means for controlling a characteristic of a sound to be outputted by said sound output means based on an extracted pitch from said pitch extracting means.

With each of these arrangements, a picked-up signal converted by the pick up means in response to a plucked string is digitally sampled to provide a digital sound source. Then, an output signal from the digital sound source is processed and controlled based on the player's string operations such as plucking and fingering, to thereby provide a most realistic sound controlled by the player's performance.

A further aspect of the invention provides an electronic musical instrument comprising: analog-to-digital converter means for successively converting an analog input signal to a corresponding digital signal; storing means for successively storing a digital signal from said analog-to-digital converter means; reading means for successively reading a stored digital signal from said storing means; digital-to-analog converter means for successively converting a read-out digital signal from said reading means to an analog audio signal; sound output means for outputting an analog audio signal from said digital-to-analog converter means as a sound; amplitude level detecting means for detecting an amplitude level of said analog input signal; and control means for controlling a characteristic of a sound to be outputted by said sound output means based on a detected amplitude level from said amplitude level detecting means.

Another aspect of the invention provides an electronic musical instrument comprising: analog-to-digital converter means for successively converting an analog input signal to a corresponding digital signal; storing means for successively storing a digital signal from said analog-to-digital converter means; reading means for successively reading a stored digital signal from said storing means; digital-to-analog converter means for successively converting a read-out digital signal from said reading means to an analog audio signal; sound output means for outputting an analog audio signal from said digital-to-analog converter means as a sound; pitch extracting means for extracting a pitch of said analog input signal; and control means for controlling a characteristic of a sound to be outputted by said sound output means based on an extracted pitch from said pitch extracting means.

The analog input signal may be supplied by any suitable audio signal supplying device such as string vibration pick up and microphone.

Each of these arrangements advantageously uses the analog input signal for a digital sound source by digitally sampling the analog input signal and controls a characteristic of a sound signal from the digital sound source such as envelope, timbre and volume based on the amplitude level and/or pitch of the analog input signal to thereby provide a most realistic sound according to a parameter of the analog input signal.

BRIEF DESCRIPTION OF THE DRAWINGS

FIGS. 2A to 2H are basic timing diagrams of recording/playback operations using the string data RAM in FIG. 1B.

FIGS. 8A to 8F are schematic diagrams illustrating an operation of a modified read and write control when the recording pointer and playback pointer approach each other;

DETAILED DESCRIPTION OF THE PREFERRED EMBODIMENT

The invention will now be described in detail by way of a preferred embodiment in conjunction with the drawings.

Figure 1A:
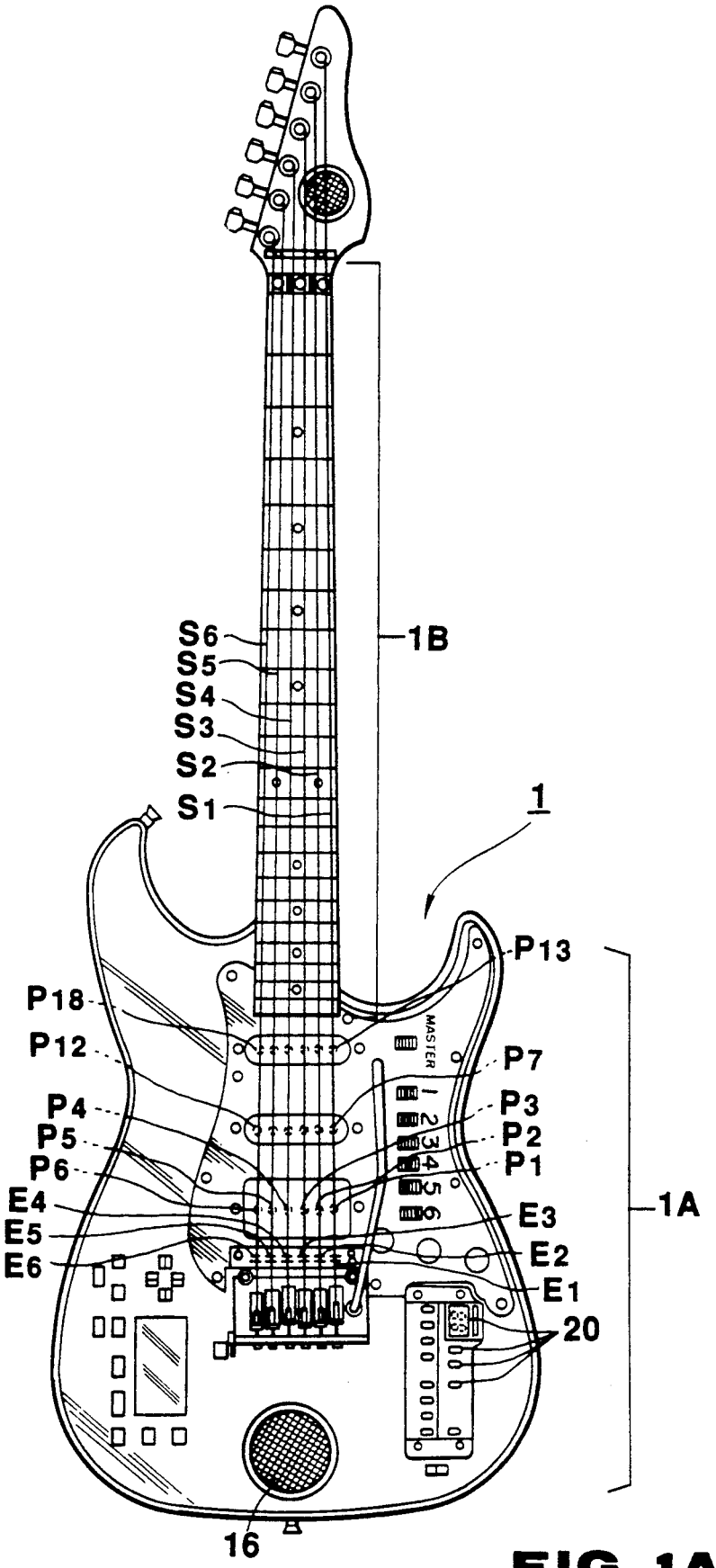
FIG. 1A is an external view of an electronic stringed instrument of an embodiment of the invention.
Figure 1B:
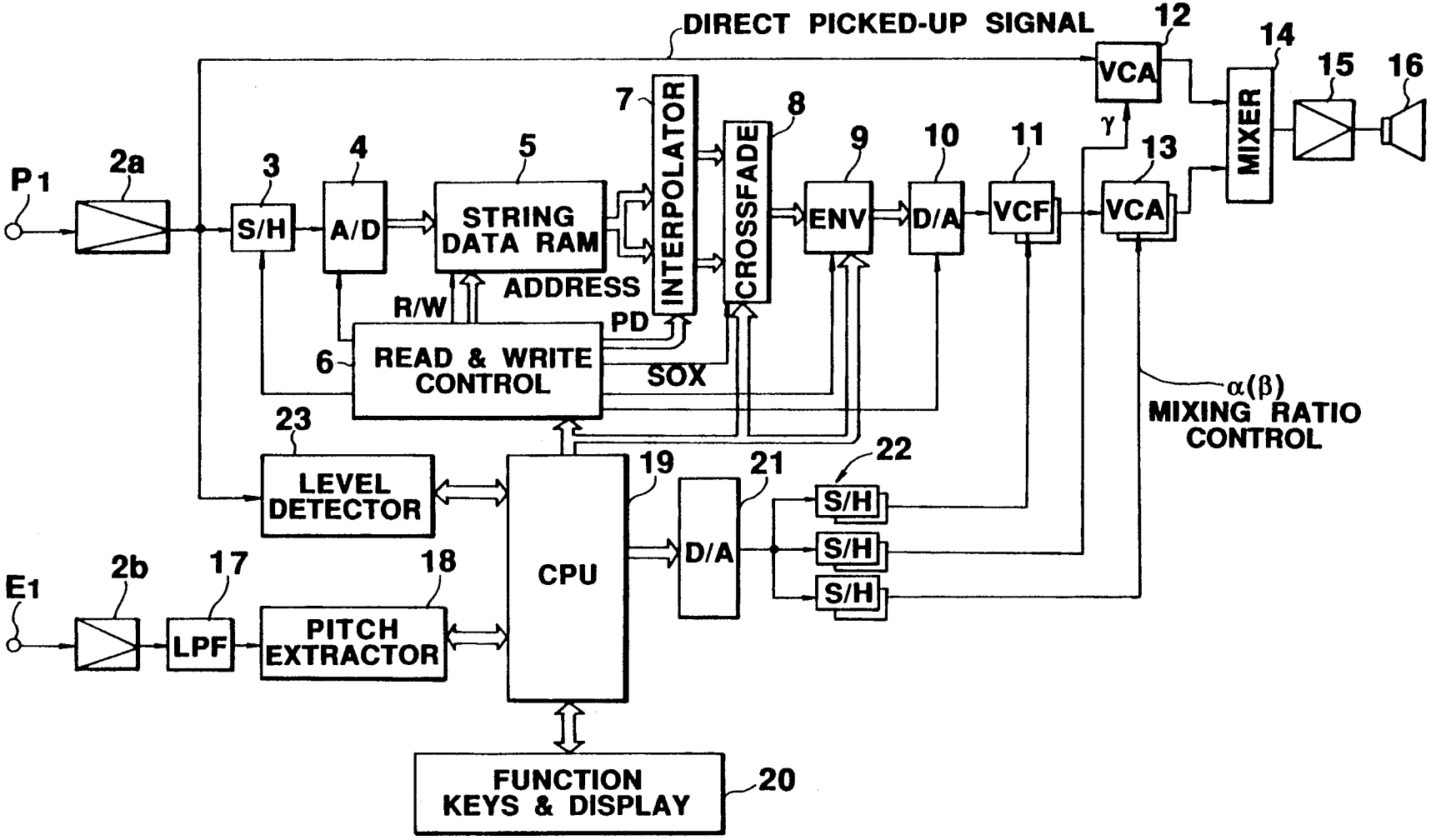
FIG. 1B is a block diagram of circuit arrangement of the instrument in FIG. 1A.

FIG. 1A shows an external view of an electronic stringed instrument 1 of the embodiment. FIG. 1B shows the circuit arrangement of the instrument 1. The instrument 1 includes six strings S1 to S6 extending over the instrument body 1A and the neck 1B. Below the strings S1 to S6, pitch extraction pick ups E1 to E6 are provided to detect vibrations of individual strings for extraction of the pitch. Direct sound pick ups P1 to P6 are also provided to detect the vibrations of each string and produce a corresponding analog electric signal. The output signals from the pick ups P1 to P6 and E1 to E6 are read into the instrument system. For clarity, FIG. 1B shows only a single pair of pick ups P1 and E1 for the first string S1. The pick ups P1 and E1 convert mechanical vibrations of the first string S1 to an analog picked-up electric signal. The pick up P1 is shown as a direct sound pick up while the pick up E1 is shown as a pitch extraction pick up. However, the same pick up may be used for direct sound and pitch extraction. Instead, other pick ups located at different positions of the string may be used for these purposes.

The direct sound pick up P1, amplifier 2*a*, voltage controlled amplifier (VCA) 12, mixer 14, amplifier 15 and speaker 16 are connected in series and constitutes a direct sound path through which the vibration signal of the first string S1 is outputted as a direct sound. The amplified picked-up string signal from the amplifier 2*a* is also fed to sample and hold (S/H) circuit 3 having an analog multiplexing function that multiplexes picked-up signals as many as the number of the strings. The sampled and held picked-up signal from S/H circuit 3 is then converted into a digital string signal by analog-to-digital (A/D) converter 4. The digitized string signal is then written (recorded) into string data RAM 5. The combination of pick up P1, sample and hold circuit 3, A/D converter 4 and string data RAM 5 thus constitutes a recording path of direct sound. Digitized samples of direct string sound stored in string data RAM 5 are supplied to interpolator 7 to produce interpolated playback data having the pitch of a processed sound. The output data from the interpolator are fed to crossfade circuit 8 which cross-fades a pair of playback signals during the crossfade period. The playback data from the cross fade circuit 8 are fed through envelope circuit 9 to produce enveloped playback data, and then fed through digital to analog converter 10 for converting into an analog playback signal. The analog playback signal is fed through voltage controlled filter (VCF) 11 to control tone timbre of the playback signal, and fed through voltage controlled amplifier (VCA) 13 to control mixing proportion of the playback (processed) sound relative to the direct sound the proportion of which is controlled by VCA 12 in the direct sound path. Thereafter, the playback signal is fed through mixer 14, amplifier 15 to speaker 16 to output the processed sound. The combination of string data RAM 5, interpolator 7, crossfade circuit 8, envelope circuit 9, D/A converter 10, VCF 11, mixer 14, amplifier 15 and speaker 16 thus defines a playback path of processed sound from the sampled direct sound data.

S/H circuit 3, A/D converter 4, string data RAM 5, interpolator 7, crossfade circuit 8, envelope circuit 9 and D/A converter 10 operate under the control of read and write control 6 which is, in turn, controlled by CPU 19 having a program ROM and a working RAM. Further, crossfade circuit 8 and envelope circuit 9 receive respective data (crossfade rate, envelope parameters) from CPU 19.

The amplified picked-up signal from the amplifier 2*a* is also connected to level detector 23 which detects a level of the picked-up signal corresponding to the peak of each vibration period and supplies the results to CPU 19.

Another picked-up signal from the pitch extraction pick up E1 is amplified by the amplifier 2*b*, filtered by low pass filter (LPF) 17 for rejecting undesired frequencies, and then fed to pitch extractor 18.

The pitch extractor 18 may be designed to detect, for example, zero crossings of the picked-up signal. Each time it detects a new zero crossing, the pitch extractor 18 interrupts CPU 19. In response, CPU 19 computes the period of zero crossings i.e., pitch of the string vibrations.

CPU 19 controls system status according to functions designated from function keys of the block 20: For example, CPU 19 sets operation mode of the read and write control 6 and associated elements and causes the display of the block 20 to display a current system state etc.

As will be described, in playback mode, or simultaneous recording and playback mode, CPU 19 uses the information (string touch level and string vibration pitch) from the level detector 23 and pitch extractor 18 to control characteristics of the processed sound.

According to the flow diagrams to be described later, CPU 19 (A) modifies the processed sound pitch based on the string vibration pitch to make it different from the direct string sound pitch, (B) controls mixing proportion of the direct sound and the processed sound based on the combination of the string vibration pitch and the string touch level and (C) modifies timbre spectrum of the processed sound based on the string vibration pitch. To achieve the function (A), CPU 19 sends the read and write control 6 pitch data for processed sound (playback address incremental value) as a function of the extracted pitch to thereby cause the read and write control 6 to read the string data RAM 5 to obtain a playback processed sound signal having a correspondingly modulated pitch. To realize the function (B), CPU 19 sends processed sound VCA 13 and direct sound VCA 12 mixing proportion data as a function of string vibration pitch and string touch level by way of digital-to-analog (D/A) converter 21 and sample and hold (S/H) circuits 22. D/A converter 21 converts digital mixing proportion data to a corresponding analog voltage signal. The analog voltage signal delivered to a sample and hold element of S/H circuits 22 having demultiplexing function. Direct sound VCA 12 comprises a plurality of VCA elements equal in number to the strings. Playback VCA 13 comprises a plurality of VCA elements twice the number of strings. A VCA 12 element and VCA 13 element connected to respective S/H 22 element holding the respective mixing proportion voltage receive the corresponding voltage and modulates each amplitude of the direct sound signal and playback signal of the corresponding string to achieve the required mixing proportions. To accomplish the function (C), CPU 19 sends VCF 11 cutoff frequency data as a function of the string vibration pitch by way of D/A converter 21 and sample and hold circuits 22. D/A converter converts the digital cutoff frequency data to a corresponding analog electric signal which is then delivered to a S/H 22 element selected by CPU 19. From the S/H 22 element, the analog voltage signal is applied to a VCF 11 element connected thereto which correspondingly filters the processed sound playback signal for modification of its tone timber.

FIGS. 2A to 2H depict timing diagrams of recording and playback sampling of the string data RAM 5, performed on time division multiplexing (TDM) basis under the control of the read and write control 6. Since the instrument has six strings, string vibration samples of at most six strings (six channels) may be recorded into the string data RAM 5, and from RAM 5, up to twelve channels (two channels per string) may be played back. In FIG. 2A, ST0 indicates a time slot in which sampling is performed with respect to the first string. The first string sampling time slot ST0 is followed by the second, third, fourth, fifth and sixth string time slots ST1 to ST5. The total interval of time slots ST0 to ST5 defines one complete sampling cycle which repeats itself. FIGS. 2B to 2H depict contents of the sampling time slot for a particular string according to sampling modes of operation. The sampling modes primarily comprise recording mode in which only recording is performed, playback mode in which only playback is performed, and recording and playback mode in which recording and playback are simultaneously performed. In each of these modes, either single or dual channels per string may be played back. Each string sampling slot STi is further divided into nine subtime slots.

In the recording mode (FIG. 2B), writing a string vibration sample W into the string data RAM 5 occurs at the first subtime slot. The remaining subtime slots, which are provided for playback, are not used (because of the recording mode) by inhibiting or masking the playback signal with the envelope circuit 9.

In the playback mode (FIGS. 2C to 2F), writing a sample into RAM 5 at the first subtime slot is inhibited. In single channel playback mode (FIG. 2C), reading a sample RB from the string data RAM 5 at a first address occurs at the second subtime slot, and reading another sample RA from RAM 5 at the next address occurs at the third subtime slot. From these two samples and the address fractional part, the interpolator 7 produces an interpolated sample of processed sound. In the single channel playback mode, if the playback sound lasts for a relatively long time, a pair of interpolated playback samples are cross-faded by the crossfade circuit 8 at appropriate times. FIG. 2D shows a time diagram of the single channel playback mode with cross-fading operation. The crossfade circuit 8 receives, as a fade-out component, a first interpolated playback sample from the interpolator 7, produced from the stored samples RB and RA, respectively read at the second and third subtime slots, and receives, as a fade-in component, a second interpolated sample from the interpolator 7, produced from adjacently stored samples RBC and RAC, respectively read at the fourth and fifth subtime slots. The crossfade circuit 8 causes the first interpolated sample to fade out and causes the second interpolated sample to fade in.

Dual channel playback mode without the cross-fading is illustrated in FIG. 2E. Adjacent samples RB0 and RA0 are read out from the string data RAM 5 at the second and third subtime slots, respectively. These samples are combined by the interpolator 7 to provide a first interpolated sample for the first playback channel. Adjacent recorded samples RB1 and RA1 are read out from RAM 5 at the sixth and seventh subtime slots, respectively, and are combined by the interpolator 7 into a second interpolated sample for the second playback channel. During the crossfade (FIG. 2F), adjacent samples RBC0 RAC0 are read at the respective fourth and fifth subtime slots and combined by the interpolator 7 to provide a third interpolated sample. The first and third interpolated samples are combined by the crossfade circuit 8 which fades out the first interpolated sample and fades in the third interpolated sample to thereby provide a playback data sample for the first playback channel. An eighth and ninth subtime slots, adjacent samples RBC1 and RBC2 are respectively read out from the string data RAM 5 and are combined by the interpolator 7 to provide a fourth interpolated sample. The crossfade circuit 8 fades out the second interpolated sample and in the fourth interpolated sample to form a playback data sample for the second playback channel.

FIG. 2G depicts a single channel playback and recording mode. A string data sample W is written into string data RAM 5 at the first subtime slot. At the second and third subtime slots, adjacent samples RB and RA are respectively read out from RAM 5 and are combined by the interpolator 7 to develop an interpolated sample of processed sound.

In recording and dual channel playback mode (FIG. 2H), additional operations are performed at the sixth and seventh subtime slots at which adjacent samples RB1 and RA1 are respectively read out from RAM 5 and are combined by the interpolator 7 to form a second playback channel data sample.

Figure 3:
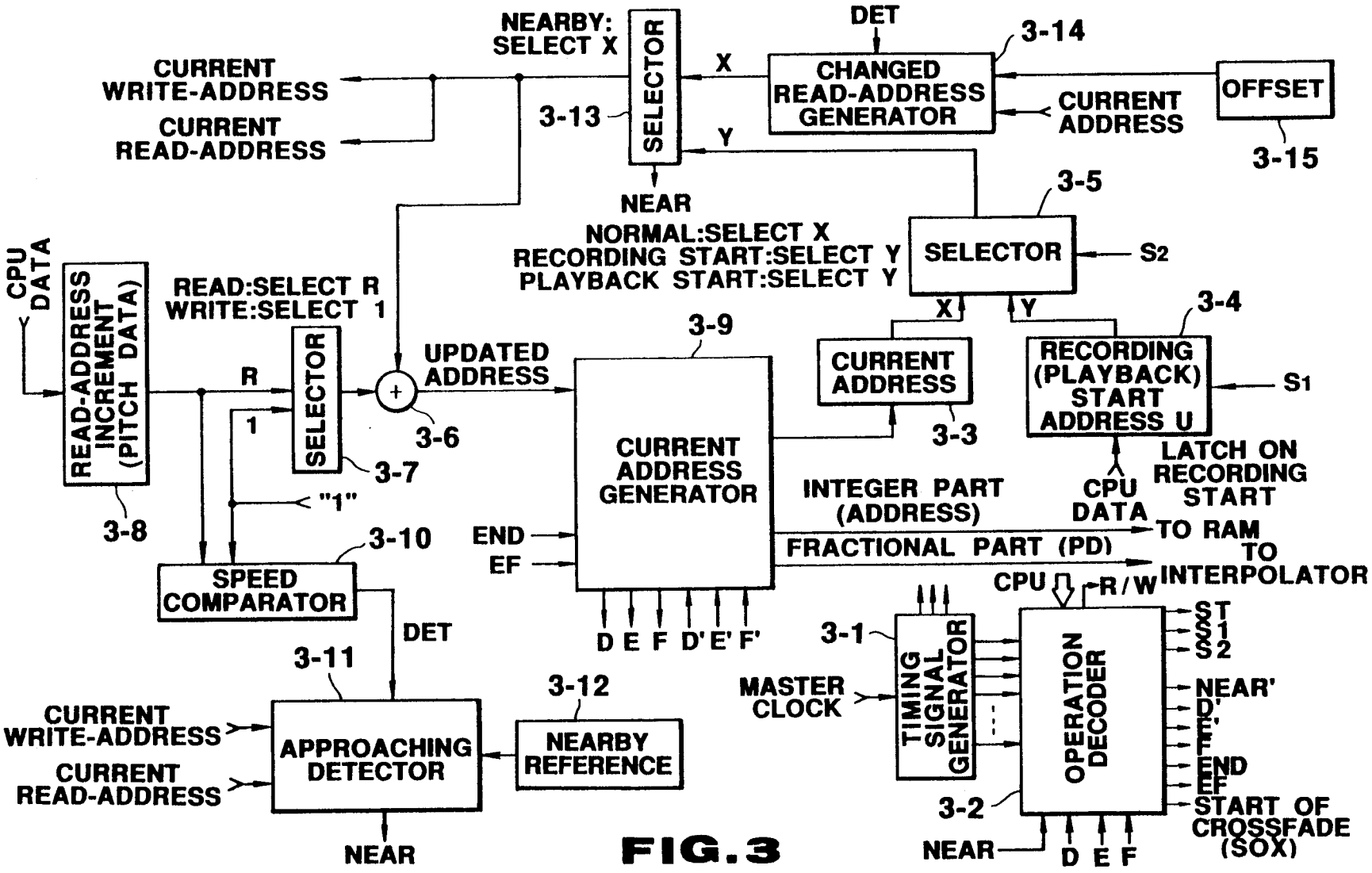
FIG. 3 is a block diagram of the read and write control in FIG. 1B.
Figure 4:
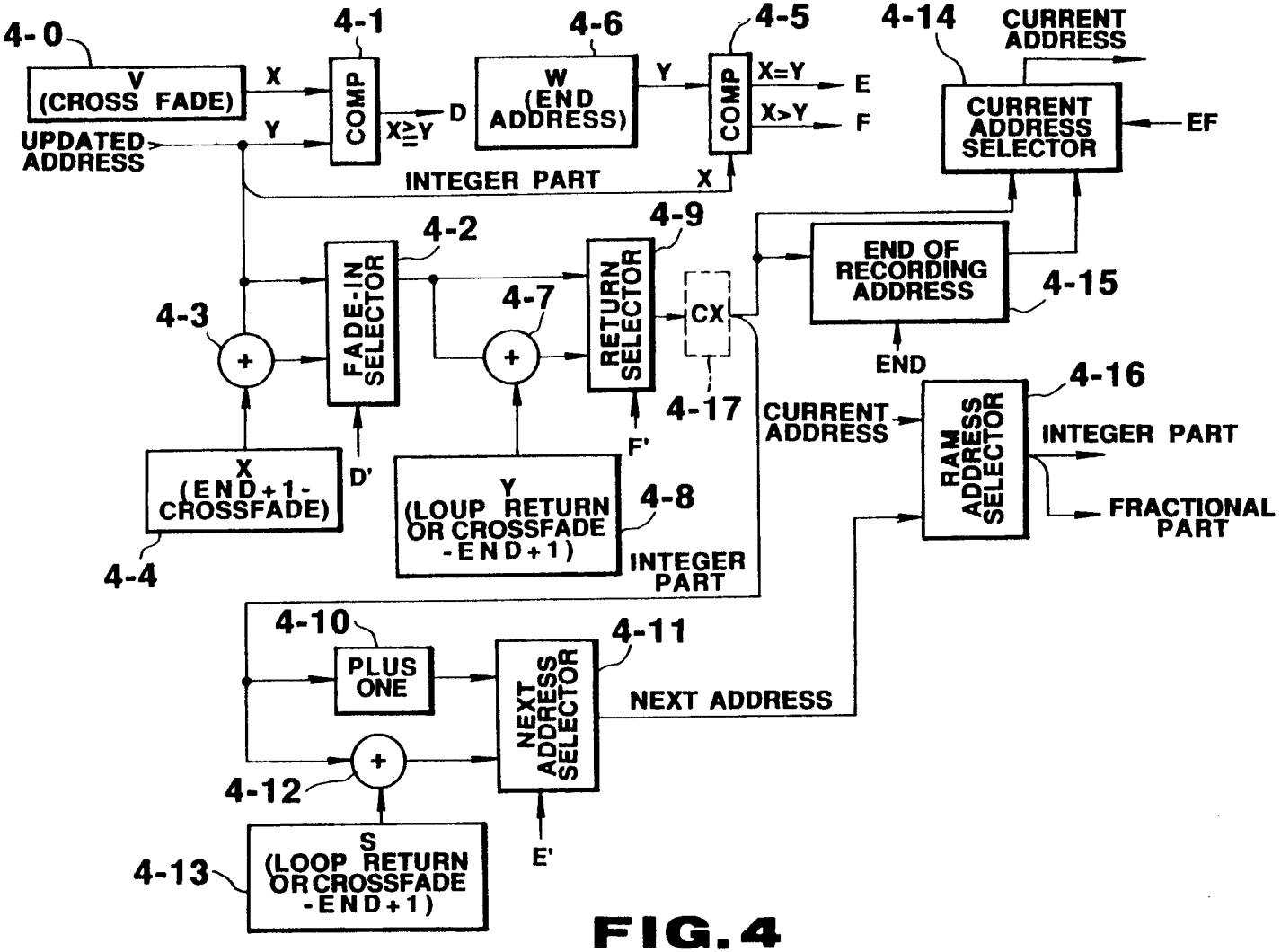
FIG. 4 is a block diagram of the current address generator in FIG. 3.

FIGS. 3 and 4 illustrate an arrangement of the read and write control 6. The read and write control 6 accesses (reads/writes) the string data RAM 5 according to time diagrams of FIGS. 2A to 2H and controls the recording path including S/H 3 and A/D 4, and playback sound processing path including elements 7 to 10.

The read and write control 6 includes a timing signal generator 3-1 which generates various timing signals and an operation decoder 3-2 which decodes commands from CPU 19 and other input signals supplied from various parts of the read and write control 6 and produces various control signals for controlling various part of the read and write control 6, recording path elements 3 and 4, and playback sound processing path elements 7 to 10.

Figure 5A:
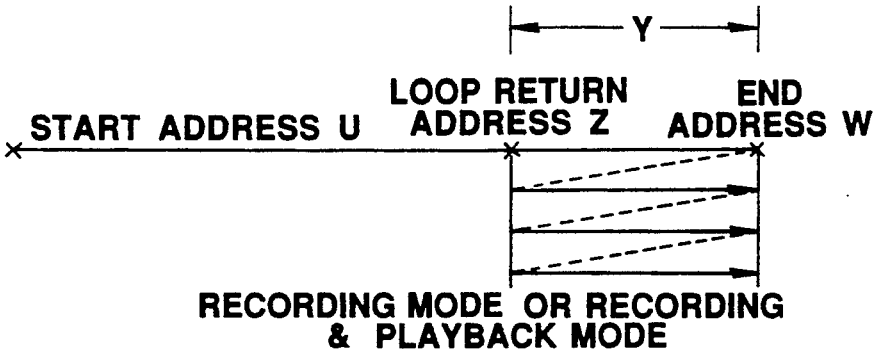
FIGS. 5A and 5B illustrate addressing the string data RAM in FIG. 1B.
Figure 5B:
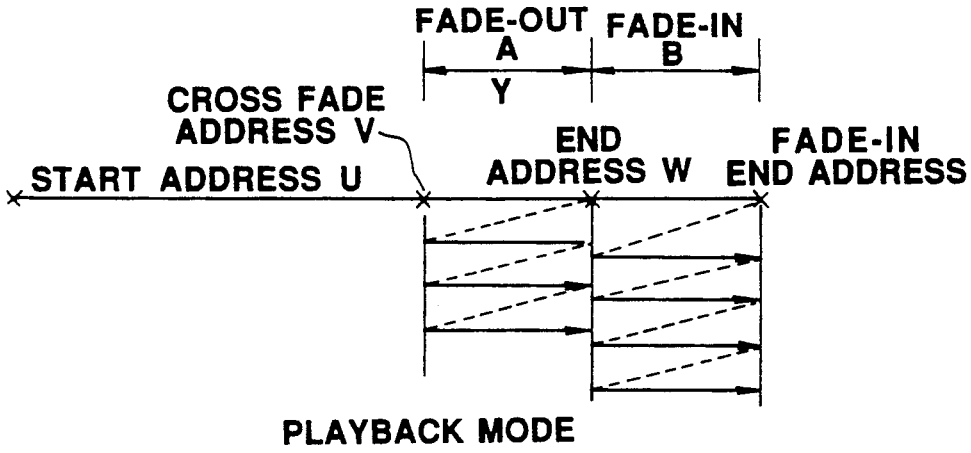

The remaining portion of the read and write control 6 is to provide an address (integer part) to the string data RAM 5 and an address fractional part to the interpolator 7. The RAM 5 addressing is summarized in FIGS. 5A and 5B. In the recording mode, or recording and playing mode (see FIG. 5A), recording data into RAM 5 starts from a predetermined address U called start address. Then, the recording address is successively incremented one by one. When the recording address reaches an end address W, it will return back to a loop return address Z. Then, recording pointer is repeatedly moved from the loop start address 2 to the end address W. The playback addressing RAM 5 in the recording and playback mode will be described later. Once the string data have been recorded in RAM 5, they are edited so that the resultant string data comprise a fade-out portion A and a fade-in portion B for subsequent playback operation.

In the playback mode (FIG. 5B), the playback address pointer starts from a predetermined start address U of the string data RAM 5, and is successively moved by an incremental step corresponding to the playback pitch until the crossfade address has been reached without crossfade operation. The unused fade-in channel signal is masked with zero. The area from the crossfade address V to end address W forms a fade-out portion while the area from the (end+1) address to fade-in end address forms a fade-in portion of the playback signal. Thus, after reaching the crossfade address both the fade-out and fade-in areas are repeatedly read out while the crossfade circuit 8 fades in (gradually increases the proportion of) the data from the fade-in area and fades out (gradually decreases the proportion of) the data from the fade-out area.

Turning back to FIG. 3, the current address register 3-3 successively receives and stores a current recording address value (recording pointer) and two current playback address values (first and second playback pointers) per each string on TDM basis and outputs them at appropriate times (see FIGS. 10A to 10F). U register i.e., recording (playback) start address register 3-4 stores a recording (playback) start address of each string and successively outputs the start address of respective channels. U register may comprise a multistage shift registers whose output is fed back to its input while shifting. Similar configuration is applied to other elements 3-8, 4-0, 4-4, 4-6, 4-8, 4-13, 9-2, 9-5, 9-7 etc. Each start address is supplied from CPU 19 and is latched into U register 3-4 in response to S1 signal from the operation decoder 3-2. The start address selector 3-5, which operates by S2 signal from the operation decoder 3-2, normally selects an output from the current address register 3-3 but selects an output from the start address register 3-4 at the start of recording or playback with S2=1. The output from the selector 3-5 is normally supplied to the adder 3-6 without any change. The case of change will be taken up later.

The adder 3-6 adds an incremented value from the selector 3-7 to the output from the selector 3-5. At a recording time, the selector 3-7 selects the value of "1". At a playback time, the selector 3-7 selects a playback address incremental value from the playback pitch data register 3-8 which stores incremental values each indicative of a playback pitch of a particular channel and transferred from CPU 19. These values are loaded into the register 3-8 in response to ST signal from the operation decorder 3-2.

The output of the adder 3-6 is the current address plus the incremental value and called the updated address. The updated address is supplied to the current address generator 3-9 the details of which are illustrated in FIG. 4. The comparator 4-1 of the current address generator 3-9 compares the updated address with a crossfade address value from register 4-0 which has been set by CPU 19. This is to determine whether the updated playback pointer has reached the crossfade address in the playback mode. If so, the comparator 4-1 provides an active D comparison signal.

The operation decoder 3-2 decodes the active D comparison signal to provide a start-of-crossfade signal SOX to the crossfade circuit 8 to initiate its operation. In addition operation decoder 3-2 supplies a pulsed signal D' to the fade-in selector 4-2 which in turn selects the fade-in playback pointer from the adder 4-3 in place of the fade-out playback pointer i.e., updated address (see FIG. 10C). The adder 4-3 adds (end address+1−crossfade address) from X register 4-4 which has been set by CPU 19 to the fade-out playback pointer to produce the fade-in playback pointer (see FIG. 5B). For example, when the fadeout playback pointer points to the crossfade address, the adder 4-3 output i.e., the fade-in playback pointer points to (end address+1) i.e., the first address of the fade-in area B. The comparator 4-5 compares the interger part of the updated address with the end address from W register 4-6 which has been set by CPU 19. This comparison is to determine when the recording or playback pointer indicated by the updated address has reached the end address W. If the interger part of the updated address is equal to the end address W, the comparator 4-5 outputs an active comparison signal E. If the interger part of the updated address is greater than the end address W, the comparator 4-6 outputs an active comparison signal F. In the latter case, recomputing the pointer is required for the looping. To this end, the adder 4-7 adds the updated address from the fade-in selector 4-2 and (loop return address or crossfade address−end address+1) from Y register 4-8 which has been set by CPU 19 to thereby recompute the returned position of the pointer. The return selector 4-9 selects either the returned position or updated address depending on signal F' from the operation decoder 3-2. The signal F' is obtained from the comparison signal F. If the pointer specified by the updated address has exceeded the end address, the selector 4-9 selects the returned position of the pointer from the adder 4-7, as a new current address pointer.

The multiplexed output from the return selector 4-9 comprises a new recording address and a new playback address of the string data RAM 5. However, in general, the playback address value does not exactly points to a storage location of the string data RAM 5 which location is given by the interger part of the playback address. The fractional part of the playback address defines the error from the storage location. Therefore, it is necessary to interpolate a data sample at a nonexisting storage location specified by (the interger part+fractional part). To this end, elements 4-10 to 4-12 are provided to develop the next address located next to the interger part of the playback address. More specifically, the plus-one circuit 4-10 increments the interger part of the playback address by one. This normally results in the next address. However, if the interger part of the playback address is equal to the end address W (see FIGS. 5A and 5B) the loop return address (or crossfade address) defines the next address. Thus, the active comparison signal E from the comparator 4-5 indicative of this condition is decoded by the operation decoder 3-2 into time adjusted signal E' which then controls the next address selector 4-11 to select the loop return address (or fade-in or fade-out crossfade address) from the adder 4-12 in place of the output from the plus-one circuit 4-10. The adder 4-12 adds the interger part of the playback address from the return selector 4-9 and (loop return or fade-in crossfade-end address) from S register 4-13 which has been set by CPU 19.

The output from the return selector 4-9, indicative of a new current address is fed back to the current address register 3-3 through the current address selector 4-14. In the recording mode, or recording and playback mode, the recording address pointer included in the multiplexed output of the return selector 4-9 must be stopped at the end of recording which is indicated by attenuated string vibrations as will be described. At the end of recording, CPU 19 sends a command of end-of-recording to the operation decoder 3-2 which in turn develops and supplies END signal to the end-of-recording address register 4-15. Then, the register 4-15 samples the recording address from the return selector 4-9 as the end-of-recording address. In subsequent sampling cycles, the current address selector 4-14 selects the output from the end-of-recording address register 4-15 in place of the output (new recording address) from the return selector 4-9 at each time of a pulsed signal EF from the operation decoder 3-2. In this manner the recording pointer is fixed to the end-of-recording address. In the recorded data edit mode after the recording, CPU 19 reads the contents of the end-of-recording register 4-5 for editing purpose.

RAM address selector 4-16 selects either the output from the current address selector 4-14 or the output from the next address selector 4-11 depending on a selecting signal (not shown) from the operation decoder 3-2. The interger part of the selected output of RAM address register 4-16 is supplied to the string data RAM for its addressing and the fractional part is supplied to the interpolator 7.

As a result, the multiplexed output from RAM address selector 4-13 indicates (see FIG. 10B) (a) a writing address of the string data RAM with the correct value in the recording mode at the first subtime slot of each string sampling time STi, (b) a first playback fade-out channel reading address (whose value is correct in either recording mode or recording and playback mode) at the second subtime slot, (c) a first playback fade-out channel next-reading address for interpolation at the third subtime slot, (d) a first playback fade-in channel reading address (whose value is correct during and after crossfade) at the fourth subtime slot, (e) a first playback fade-in channel next reading address for interpolation at the fifth subtime slot (f) a second playback fade-out reading address (whose value is correct in the dual channel playback mode, or simultaneous recording and dual channel playback mode) at the sixth subtime slot (g) a second playback fade-out next reading address for interpolation at the seventh subtime slot (h) a second playback fade-in reading address (whose value is correct during and after crossfade) at the eighth subtime slot, and (i) a second playback fade-in next reading address at the ninth subtime slot.

Figure 6:
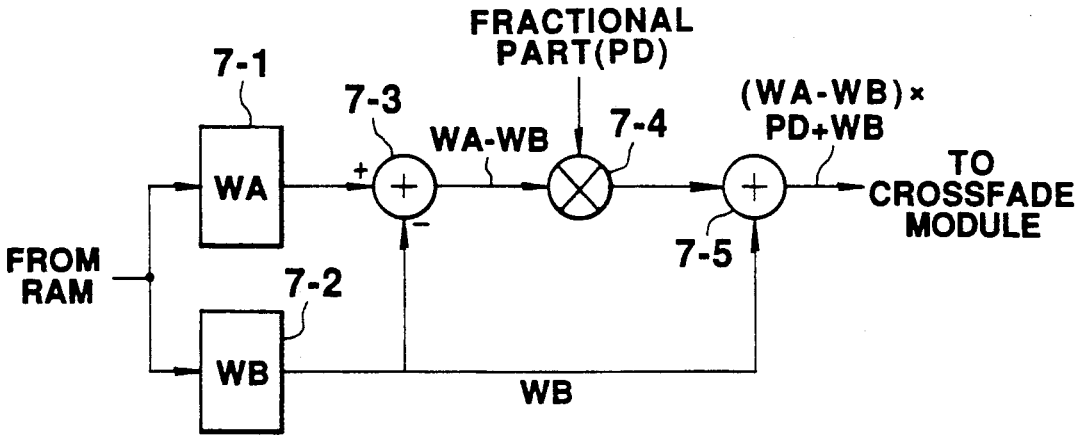
FIG. 6 is a block diagram of the interpolator in FIG. 1B.

In the interpolator 7 of FIG. 6, WB register 7-2 is loaded with a string data sample at a storage location of the string data RAM 5 specified by the interger part of the current playback address. WA register 7-1 is loaded with another string data sample at the next storage location of RAM 5. The adder 7-3 calculates the difference (WA-WB) between the adjacent samples. The multiplier 7-4 multiplies the difference (WA-WB) by the fractional part PD of the current playback address. The adder 7-5 adds the output from the multiplier 7-4 to the output from WB register 7-2 to provide a linear-interpolated string data sample at the interger plus fractional parts of the current playback address.

As seen from FIG. 3, the recording pointer scanning writing addresses of the string data RAM 5 is moved or stepped at the rate of "1". On the other hand, the playback pointer scanning reading addresses of the string data RAM 5 is stepped at a rate determined by the value set into the read-address increment register 3-8 from CPU 19. In general, the stepping rate or speed of the playback pointer, therefore the playback sound pitch is not necessarily equal to the stepping speed of the recording pointer therefore the recorded sound pitch. In particular, the present embodiment may operate in the recording and playback mode in which both the recording and the playback are concurrently performed. In such simultaneous recording and playback mode, the played-back sound may have a different pitch from that of the recorded sound by setting the read-address increment register to a value other than "1". This, however, gives rise to the passing problem that one of the recording pointer and the playback pointer passes the other. If the playback pointer moves faster than the recording pointer, the former moves toward and eventually beyond the latter pointer so that the read and write control 6 will read unrecorded area of RAM 5 having no data. Even if the recording pointer moves faster, it may pass the playback pointer in the case of addressing RAM 5 in a loop to save the storage capacity.

Figure 7A:
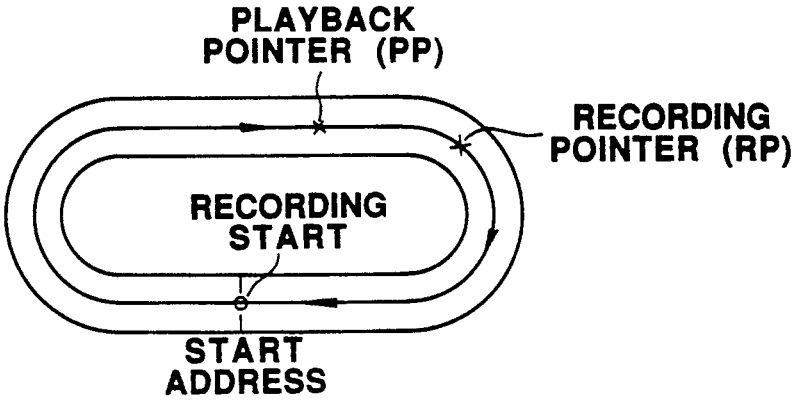
FIG. 7A to 7C are schematic diagrams illustrating an operation of the read and write control when the recording pointer and playback pointer approach each other.
Figure 7B:
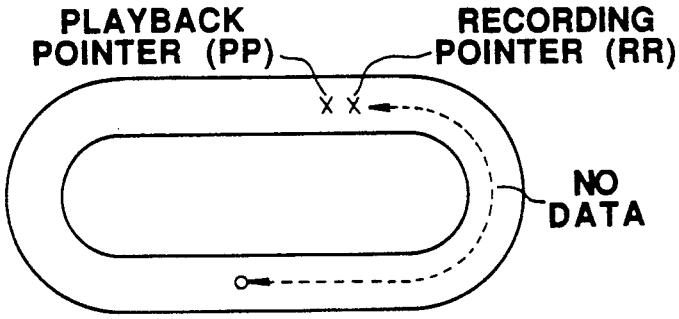
Figure 7C:
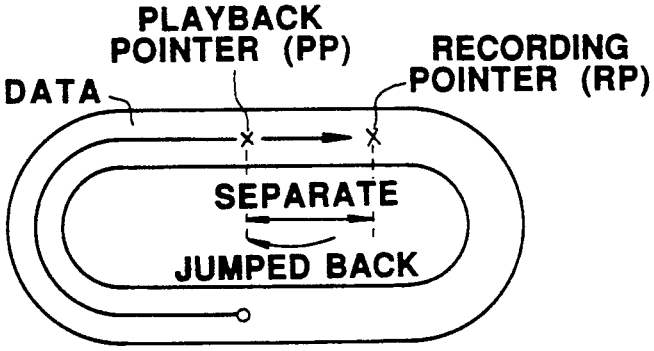

FIGS. 7A to 7C illustrates a solution of the passing problem discussed above. A playback pointer is denoted by PP and a recording pointer is denoted by RP. It is assumed here that each pointer PP, RP loops from the start address to the end address as shown in FIG. 7A. At the start of recording, the recording pointer PP is located at the start address while the playback pointer is located ahead of the recording pointer. String data have been recorded from the location of the start address to the present location of the recording pointer RP. If the speed of the playback pointer PP is higher than that of the recording pointer RP, the playback pointer PP approaches the recording pointer RP as shown in FIG. 7B. When such approaching occurs, the location of the playback pointer PP is jumped back to separate from the recording pointer in accordance with the solution, a shown in FIG. 7C. In this manner, the read and write control can continue reading recorded string data from RAM 5 by jumping back the playback pointer PP each time it approaches the recording pointer RP while the recording operation goes on.

The jump back solution is realized by the portion of read and write control 6 which has not yet been taken up. The portion comprises elements 3-10 to 3-15. More specifically, the speed comparator 3-10 compares the write-address incremental value of "1" indicative of the speed of the recording pointer RP with the read-address incremental value indicative of the speed of the playback pointer PP to provide their magnitude comparison DET. The approaching detector 3-11 computes the difference between the current write-address (recording pointer) and the current read-address (playback pointer) depending on the comparison DET, and compares the difference with a nearby reference from the register 3-12. If the difference is smaller than the nearby reference, the approaching detector 3-11 outputs an active NEAR signal. The operation decoder decodes the active NEAR signal into time adjusted NEAR' signal pulse. In response to this signal NEAR', the selector 3-13 selects the changed (jumped back) address from the changed address generator 3-14 in place of the playback address from the selector 3-5. The changed read-address generator 3-14 adds or subtracts, depending on the speed comparison DET, an offset value from the offset register 3-15 indicative of the amount of the jumped-back and already set by CPU 19 to or from the current playback pointer from the current address register 3-3 to thereby provide the jumped-back location of the playback pointer.

In this manner, the jumped-back function discussed in conjunction with FIGS. 7A to 7C are realized to assure continuous operation of simultaneous playback and recording.

FIGS. 8A to 8F illustrate another solution to the pointer passing problem. With the first-mentioned solution, a click noise can be generated in the processed sound when the playback pointer is jumped back. The second solution in FIGS. 8A to 8F combines the jumped-back solution with the crossfade technique to avoid the noise while continuing the recording and playback operation.

FIG. 8A indicates a normal condition in which the playback pointer PP is separated well from the recording pointer RP. If the playback pointer PP moves faster than the recording pointer RP, it will eventually approache the recording pointer RP as shown in FIG. 8B. In response to the approaching, the second solution forms another (fade-in) playback pointer PP2 which is sufficiently remote from the recording pointer PP, and starts the crossfade circuit 8 so that the first data processed from the string data RAM 5 using the (fade-out) playback pointer PP will fade out while the second data processed from RAM 5 using the playback pointer PP2 will fade in, as shown in FIG. 8C. At the start of crossfade, the first or fade-out processed data is weighted by "1" while the second or fade-in data is weighted by "0". The weighted sum forms the output of the crossfade circuit 8. Thereafter, as the pointers RP, PP and PP2 move, the proportion of the fade-out processed data to the net output of the crossfade circuit 8 gradually decreases whereas the proportion of the fade-in processed data based on PP2 relatively increases (see FIG. 8D). When the PP fade-out proportion falls down to zero percent and the PP2 fade-in proportion rises up to 100 percent, the crossfade circuit 8 terminates the operation (FIG. 8E). The nearby reference for initiating the crossfade operation should be chosen to an appropriate value so that the fade-out playback pointer PP will not pass the recording pointer RP before the crossfade operation completes. Thereafter, the playback operation is performed using the playback pointer PP2 (see FIG. 8F).

In the case where the recording pointer moves faster than the playback pointer, the fade-in playback pointer is formed to locate ahead of the recording pointer with a sufficient separation.

In this manner, each time approaching occurs between the playback pointer and the recording pointer, the second solution forms another playback pointer at a location remote from the recording pointer and puts the crossfade circuit 8 into operation to thereby avoid any click noise in the processed sound while assuring continued operation of simultaneous recording and playback.

Figure 9:
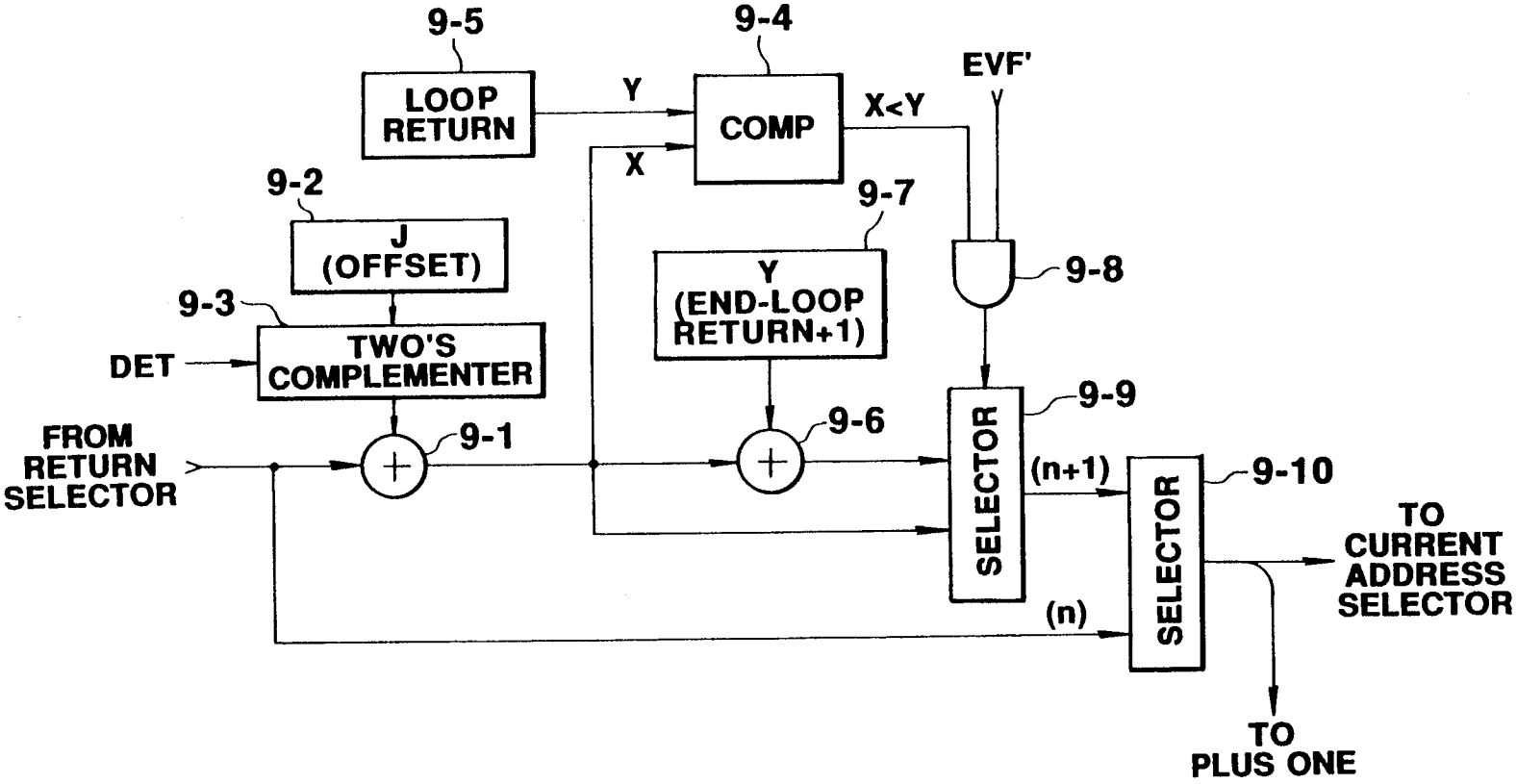
FIG. 9 is a block diagram of fade-in address generator (CX) in FIG. 4 to realize the operation illustrated in FIGS. 8A to 8F.
Figure 10:
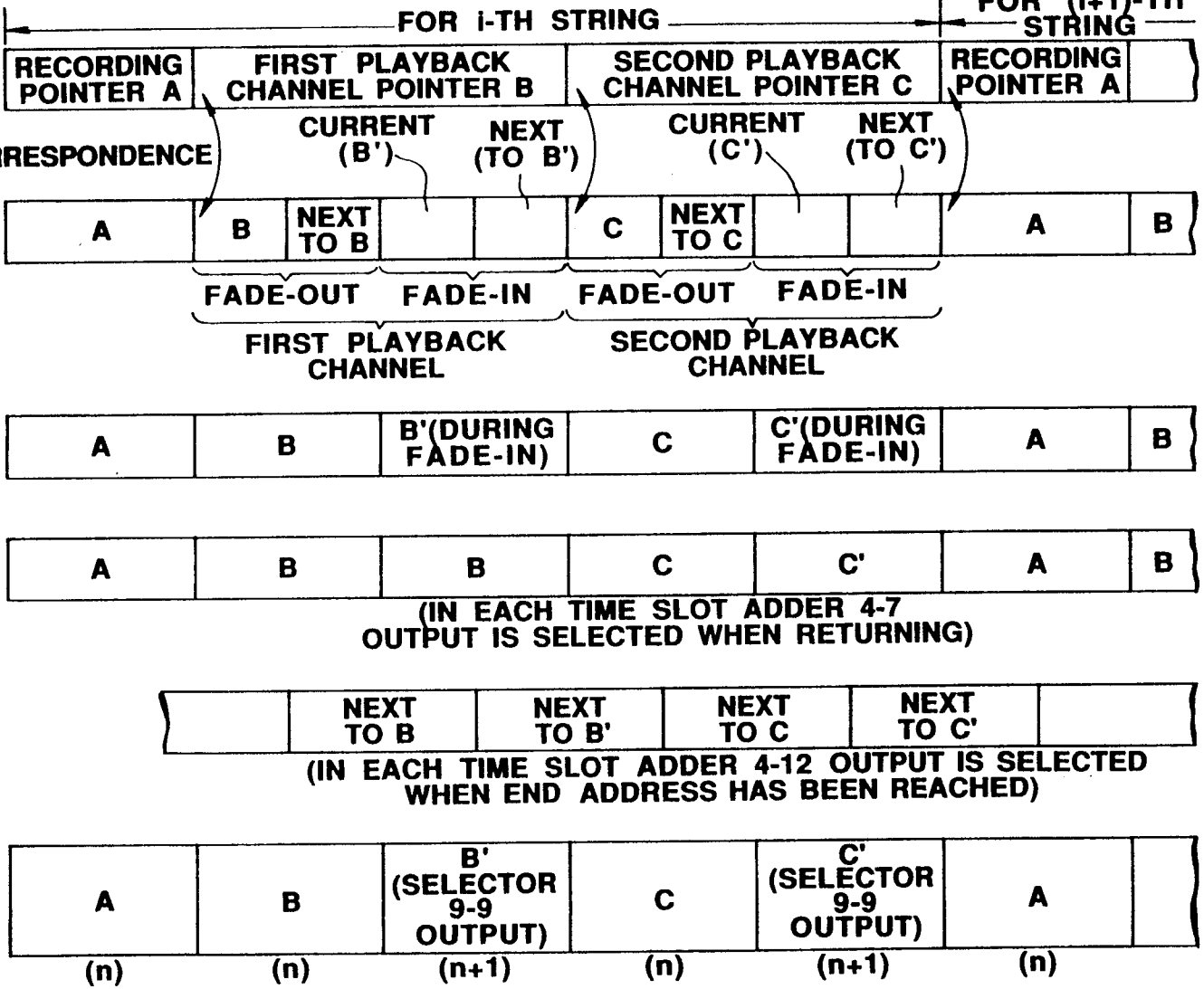
FIGS. 10A to 10F are timing diagrams of various parts of the read and write control.

The second solution is embodied by the arrangement of FIG. 9. This arrangement is a fade-in address generator which is denoted by CX 4-17 in FIG. 4 and connected to the output of the return selector 4-9. When using the fade-in address generator 4-17, elements 3-13 to 3-15 associated with the first solution are omitted, however elements 3-10 to 3-12 remain. The nearby register 3-12 is set by CPU 19 to an appropriate nereby reference value. The nearby detecting elements 3-10 to 3-12 and the fade-in address generator 4-17 of FIG. 9 in combination with the crossfade circuit 8 realize the second solution.

In FIG. 9, the adder adds an offset value from J register 9-2 (which has been set by CPU 19) through two's complementer 9-3 to the playback pointer (n) from the return selector 4-9 in FIG. 4. The two's complementer 9-3 directly passes the (positive) offset value from J register 9-2 without change according to the speed comparison DET from the element 3-11 when the recording pointer moves faster than the playback pointer so that the adder 9-1 outputs (playback pointer+J). When the recording pointer moves slower than the playback pointer, the two's complementer 9-3 complements J so that the adder 9-1 output (playback pointer−J). In this way the adder 9-1 output normally specifies the location of the fade-in playback pointer.

The looped addressing (see FIG. 5A) must be, however, considered. That is, for the (fade-out) playback pointer greater than the loop return address Z, it is necessary to determine whether that playback point has passed the end address W or not yet and to recompute the fade-in playback pointer from the adder 9-1 according to the determined results. For the playback pointer (n) moving faster than the recording pointer, the fade-in playback pointer obtained from the adder 9-1 is located behind (in FIG. 5A, to the left of) the playback pointer (n) from the return selector 4-9 by the offset value. If the playback pointer (n) has already passed the end address W, the fade-in playback pointer from the adder 9-1 should be relocated in the loop area Y to the right by the loop length. To this end, the comparator 9-4 compares the fade-in playback pointer from the adder 9-1 with the loop return address from Z register 9-5 which has been set by CPU 19. The adder 9-6 adds the fade-in playback pointer from the adder 9-1 and the loop length given by (end address−loop return address+1) from Y register 9-7 which has been set by CPU 19 to move right the adder 9-1 output by the loop length Y. If the fade-in playback pointer from the adder 9-1 is smaller than the loop return address as indicated by the output from the comparator 9-4 and if the fade-out playback pointer has passed the end address, as indicated by EVF' (which is obtained from holding signal E or F), the AND gate 9-8 provides an active signal in response to which the selector 9-9 selects the relocated fade-in playback pointer from the adder 9-6 in place of the adder 9-1 output. The selector 9-10 multiplexes the fade-in playback pointer (n+1) from the selector 9-9 and the output from the return selector 4-9 including the fade-out playback pointer (n), and supplies the multiplexed output to the current address selector 4-14 etc.

In the recording and playback mode, when an approaching event occurs between the recording pointer and the playback pointer (n), the nearby detector 3-11 outputs an active NEAR signal. Prior to the approaching, the fade-in address generator of FIG. 9 has continued computing the to-be-fade-in playback pointer (n+1) as well as passing the to-be-fade-out playback pointer (n). Using these playback pointers, string data are read out from RAM 5 and supplied to the crossfade circuit 8 by way of the interpolator 7. However, before the approaching, the crossfade circuit 8 has not yet started its crossfade operation so that it has outputted processed sound data associated with the to-be-fade-out playback pointer (n). If the NEAR signal becomes active, this signal is decoded by operation decoder 3-2 which then supplies a start-of-crossfade signal SOX to the crossfade circuit 8. In this response the crossfade circuit 8 starts fading out the processed sound data based on the playback pointer (n) and fading in the processed sound data based on the playback pointer (n+1). When such crossfade operation completes, the crossfade circuit 8 sends back an end-of-crossfade signal (not shown) to the operation decoder 3-2 which in turn controls the current address register 3-3 to select the fade-in completed playback pointer (n+1) in place of the fade-out completed playback pointer (n). Thereafter, the fade-in completed playback pointer functions as a new to-be-fade-out playback pointer (n), and a new to-be-fade-in playback pointer (n+1) is formed by the fade-in address generator 4-17.

The description now turns to the operation of CPU 19.

Figure 11:
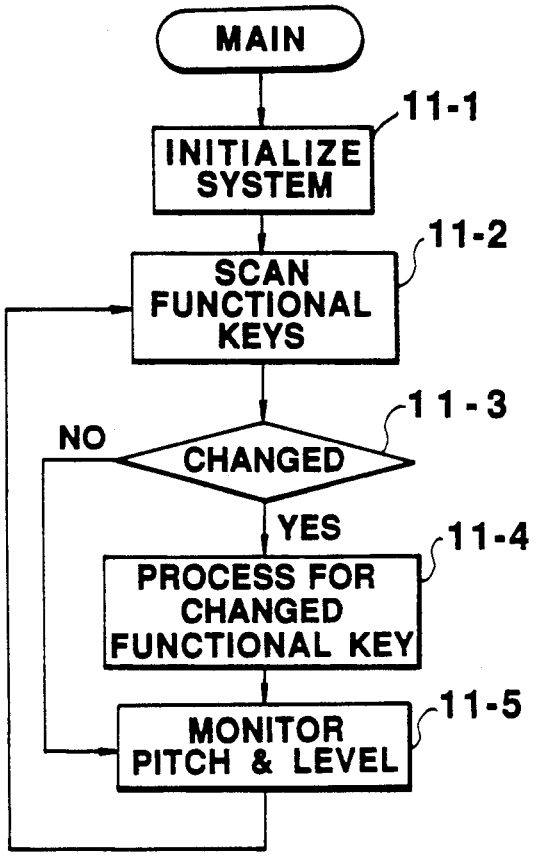
FIG. 11 is a flow diagram of the main routine of CPU in FIG. 1B.

FIG. 11 shows a flow diagram of the main routine executed by CPU 19. Upon power on, CPU 19 initializes the system (11-1). After the initialization, CPU 19 repeats the main loop 11-2 to 11-5. CPU 19 scans the function keys of function keys and display 20. If an function key is changed (11-3), CPU 19 performs an associated process for the changed key (11-4). At block 11-5, CPU 19 performs a Monitor Pitch and Level routine by reading the state of the strings and sending a control command to the read and write control 6 as required.

Figure 12:
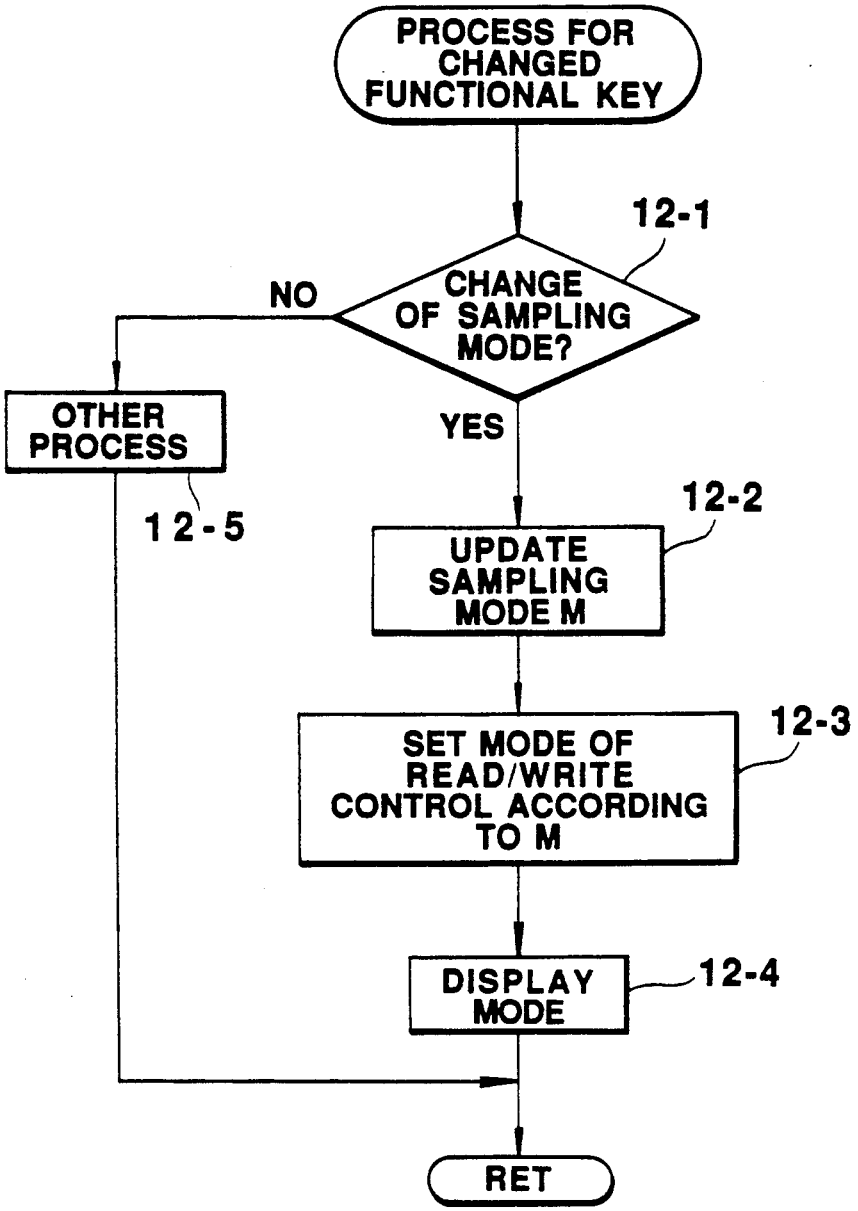
FIG. 12 is a flow diagram of process for changed functional key executed by CPU.

As illustrated in FIG. 12, the process for changed key routine 11-4 includes setting of the sampling modes described in connection with FIGS. 2A to 2H. If a new sampling mode is selected from the input unit (12-1), CPU 19 updates the sampling mode flag M. The sampling mode flag M indicates the recording mode with "0", single channel playback mode with "1", dual channel playback mode with "2", recording and single channel playback mode with "3" and recording and dual channel playback mode with "4". Then, CPU 19 sets the read and write control 6 to the mode information according to the updated sampling mode flag M. The mode information comprises information on write-controlling of the string data RAM 5, envelope circuit inhibiting (masking) information and reference data for RAM 5 such as starting address of recording (playback) pointer, crossfade address V, end address W, X, Y, S ets. For example, for the recording mode, the start address register 3-4, W register 4-6 and S register 4-13 are set to appropriate data, the envelope circuit 9 is mashed with respect to all playback channels, a write RAM signal R/W generates at the first subtime slot of each string sampling time, and S/H 3 and A/D converter 4 in the recording path are enabled. At block 12-4, CPU 19 displays the selected mode on the display screen of the function keys and display 20 for confirmation.

Figure 13:
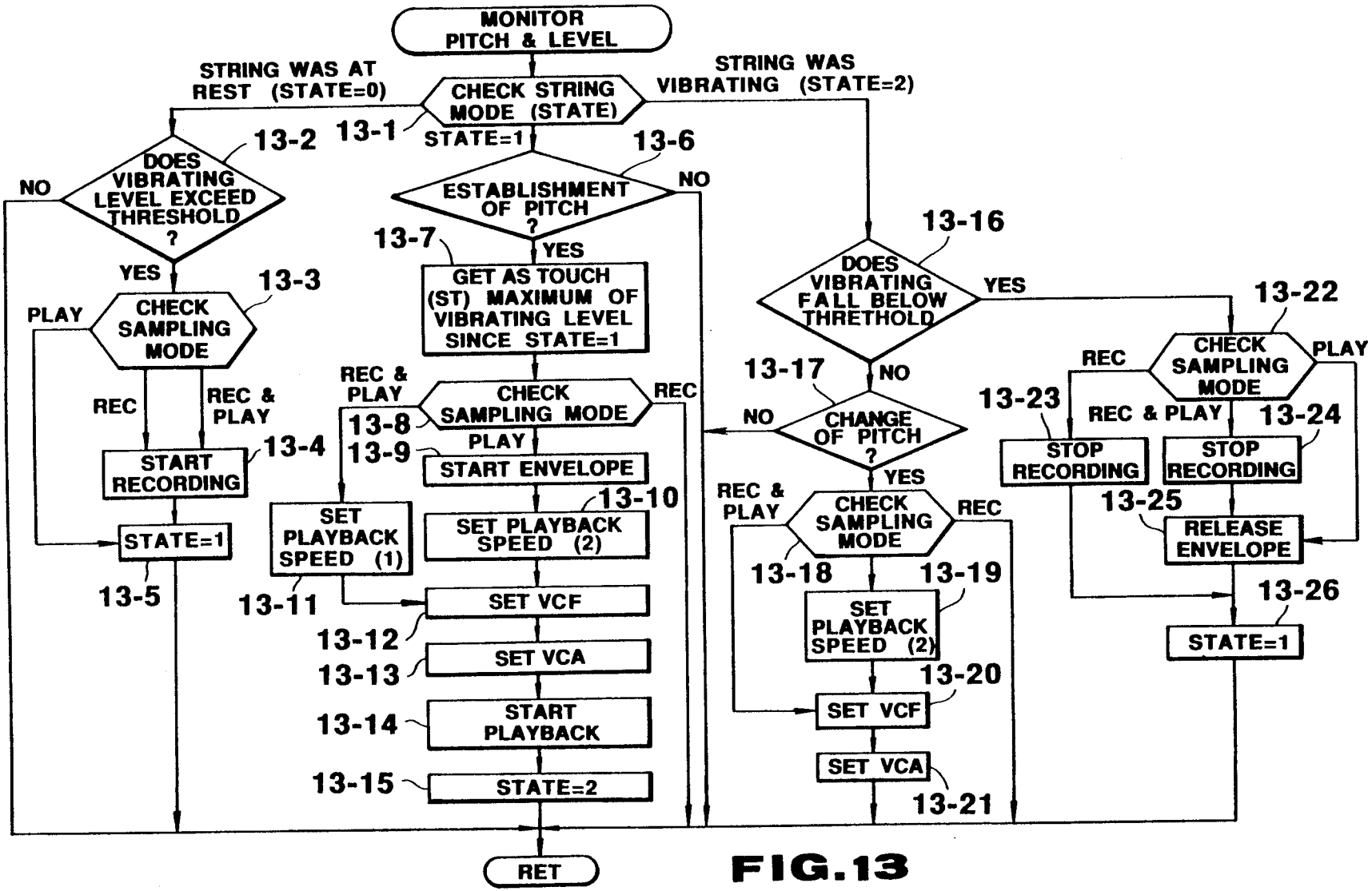
FIG. 13 is a flow diagram of a monitor pitch and level routine executed by CPU.

The Monitor Pitch and Level routine is executed according to the flow of FIG. 13 which is illustrated with respect to a single string and is repeated as many as the number of the strings of the instrument 1 while incrementing a string counter (not shown).

At block 13-1, CPU 19 checks the state of the string (STATE) pointed to by the string counter. STATE flag indicates a rested string with "0", start of string vibrations with "1" and in the course of vibrations with "2", each in the previous sampling cycle. If STATE flag indicates the rest state, CPU 19 checks to see whether the current string vibration level sampled by the time interrupt routine of FIG. 14B for sampling the vibration level exceeds a threshold indicative of start of vibrations (13-2). If the sampled vibration level does not exceed the threshold, Monitor Pitch and Level routine terminates for, the string under examination. If it exceeds, CPU 19 checks the sampling mode flag M (13-3). If the selected sampling mode is either the recording mode or the simultaneous recording and playback mode, CPU 19 commands the read and write control 6 to start the recording vibration samples of the string of interest (13-4). As a result, the start address selector 3-5 selects the data from U register 3-4 having been set for the string, as the start location of the recording pointer to thereby start recording string vibration data into RAM 5 from the start location. At block 13-5, STATE flag is changed to "1" indicative of start of string vibration irrespective of the selected sampling mode.

Figure 14A:
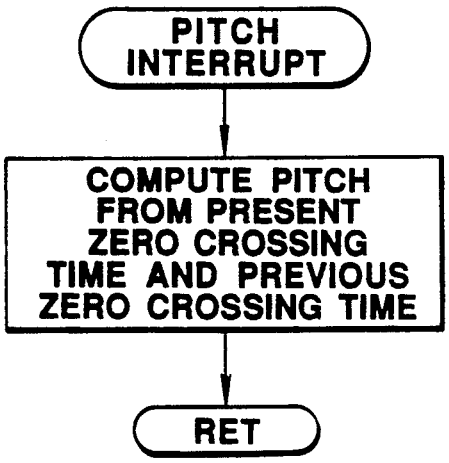
FIG. 14A is a flow diagram of a pitch interrupt routine executed by CPU.

Once the string has started vibrating, Monitor Pitch and Level routine branches from the string state block 13-1 to pitch check block 13-6 to see whether a first pitch of the string vibration has been established. The string pitch is computed by the pitch interrupt routine of FIG. 14A which is periodically performed. The pitch interrupt routine is activated in response to an interrupting request from the pitch extractor 18 when the pitch extractor 18 detects, for example, a zero crossing of the string vibration picked-up signal. Then, the pitch interrupt routine computes a period of the string vibrations i.e., string pitch by subtracting the count of a free-running counter (not shown) at the previous zero crossing time from the count at this time of zero crossing. Block 13-6 compares a new pitch with an old pitch from the pitch interrupt routine, and determines that the string pitch has been established if the new pitch is the same as the old pitch. Before the establishment of the string pitch, Monitor Pitch and Level routine terminates. When pitch has been established, block 13-7 gets the maximum of vibration amplitude level since the tring state flag STATE has been changed to "1", as string touch data TOUCH (ST). Then, CPU 19 checks the sampling mode (13-8). If the selected sampling mode is the playback mode, CPU 19 commands the envelope circuit 9 through the operation decoder 3-2 of the read and write control 6 to thereby start or attack the envelope (13-9). In this block 13-9, the string touch level measured this time from the plucked string may be normalized by the touch level measured at the previous recording time, and the envelope circuit may modify envelope parameters as a function of the normalized string touch level, if desired. This substantially keeps volume balance between the direct sound and the processed sound however hard or soft the touch level of the plucked string may be.

Then CPU 19 sets playback speeds (2) at block 13-10, sets VCF at block 13-12 and sets VCA at block 13-13.

If the selected sampling mode is the recording and playback mode (13-8), CPU 19 executes block 13-11 to set playback speed (1) before setting VCF at block 13-12.

Then, at block 13-14, CPU 19 commands the read and write control 6 to start playback operation. In response, the start address selector 3-5 of the read and write control 6 selects data from U register 3-4, as the start location of the playback pointer, and from the start location, the playback operation on the string data samples in RAM 5 is started. At the final block 13-15, CPU 19 changes STATE flag to "2" indicative of the string in the course of vibrating.

Figure 14B:
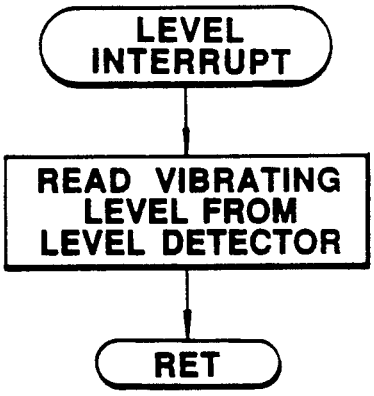
FIG. 14B is a flow diagram of a vibration level interrupt routine executed by CPU.

Thereafter, Monitor Pitch and Level routine branches from the string state check block 13-1 to block 13-16 to see whether the current string vibration level obtained from the level interrupt routine of FIG. 14B has fallen below a threshold indicative of end of vibration. If not, CPU 19 checks change of the string pitch (13-17). If there is no pitch change, Monitor Pitch and Level routine terminates. If the string pitch has changed, Monitor Pitch and Level routine checks the sampling mode (13-18). If the selected sampling mode is the recording mode, Monitor Pitch and Level routine will terminate. In the case of the playback mode, CPU 19 commands the read and write control 6 to change the playback speed according to the changed string pitch (13-19) by setting playback speed (2) which comprises updating contents of the read-address increment register 3-8 of the read and write control 6. The CPU 19 sets VCF at block 13-20 and VCA at block 13-21. If the selected mode is the recording and playback mode (13-18), CPU 19 executes setting VCF and VCA at the respective blocks 13-20 and 13-21, but ships the playback speed setting block 13-19 since any change in the string pitch also appears in the playback pitch.

If an end of string vibrations is detected at block 13-16, Monitor Pitch and Level routine checks the selected sampling mode (13-22). In the case of the recording mode, CPU 19 commands the read and write control 6 to terminate the recording operation (13-23). In this response, end-of-recording address register 4-15 samples the recording pointer at that time to thereby stop the stepping of the recording pointer. In the case of the recording and playback mode (13-22), CPU 19 commands the read and write control 6 to terminate the recording and controls the envelope circuit 9 to release the envelope, thus turning off the processed sound (13-25). For the playback mode (13-22), CPU 19 executes envelope release block 13-25. In each sampling mode, CPU 19 changes STATE flag to "0" indicative of a rested string state.

Figure 15:
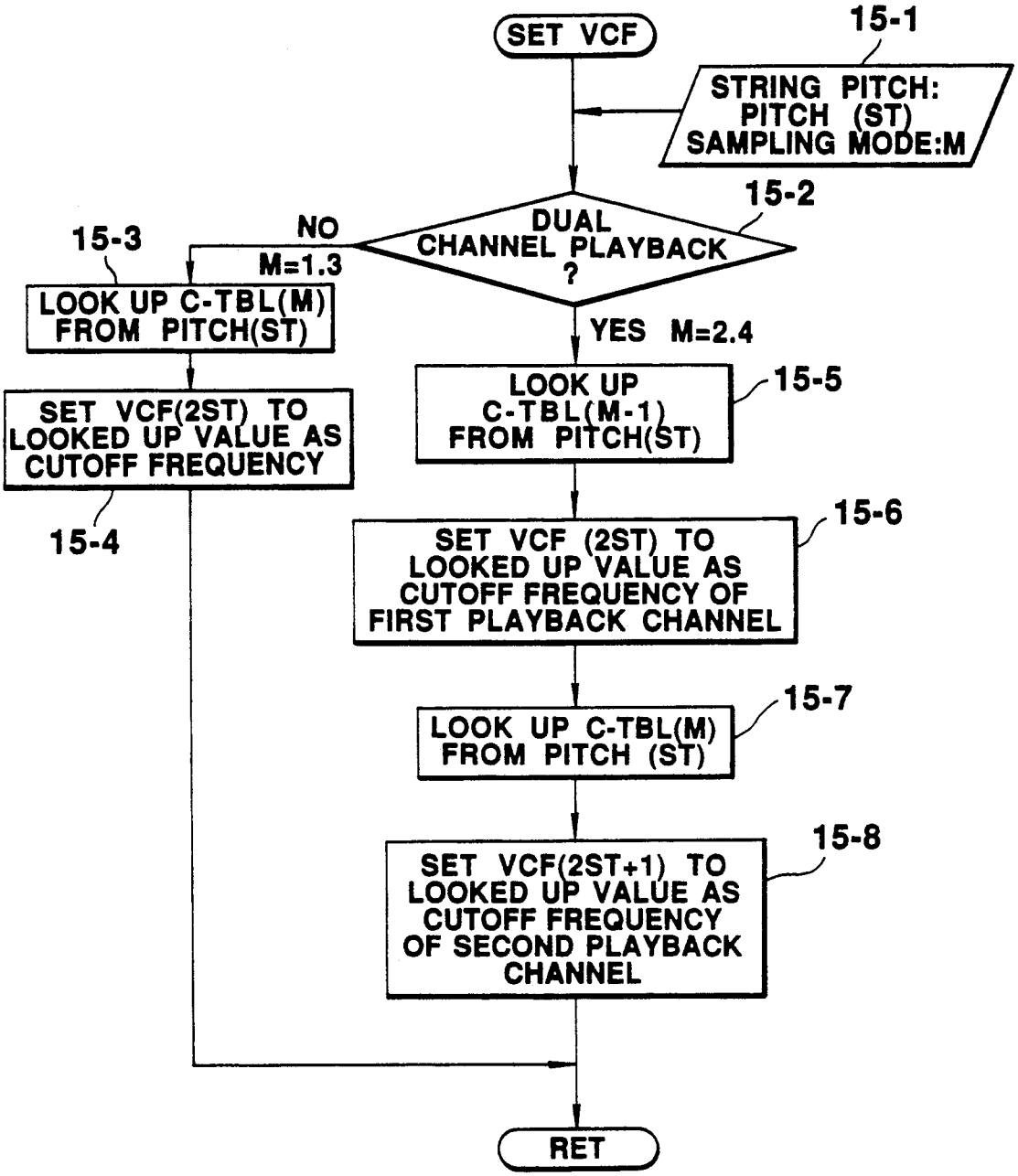
FIG. 15 is a flow diagram of set VCF executed by CPU for modifying a tone timbre.
Figure 19:
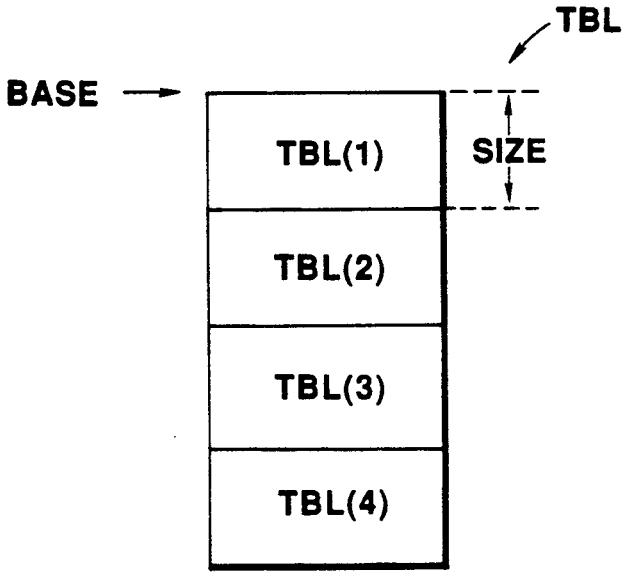
FIG. 19 illustrates a format of a look-up table.

FIG. 15 illustrates a detailed flow diagram of the set VCF routine 13-12, 13-20. The purpose of this routine is to process the tone timbre of processed sound as a function of the extracted string pitch. As indicated in the block 15-1, the set VCF routine references the string pitch PITCH (ST) extracted from ST-th string being played and the selected sampling mode M. At block 15-2, CPU 19 checks the mode flag M to see whether the selected sampling mode is either dual channel playback mode indicated by M=2 or 4, or single channel playback mode indicated by M=1 or 3 (see FIGS. 2D, 2E, 2G and 2H). In the case of the single channel playback mode, using the extracted string vibration pitch PITCH (ST), CPU 19 looks up a look-up table C-TBL(M), residing in the internal ROM of CPU 19, thus obtaining the looked-up value. As shown in FIG. 19 the general form of a look-up table comprises four subtables TBL(M) according to M values. The start address of the look-up table is specified by BASE, and the size of each subtable TBL(M) is given by SIZE. This form also applies to other look-up tables P-TBL(M), T-TBL(M) and F-TBL(M) to be described later as well as C-TBL(M). According to the form, the looked-up address LU-ADDR of the look-up table corresponding to PITCH (ST) is given by:

$$\text{LU-ADDR}=\text{BASE}+\text{SIZE}\times(\text{M}-1)+\text{INT}[\ln\{\text{PITCH(ST)}/\text{C}\}]$$

where ln indicates logarithm, C denotes a contant, the term ln{PITCH(ST)/C} indicates a cent proportional value of the extracted string pitch PITCH(ST), and INT stands for interger part. The data item stored at the looked up address defines the looked up value which, in the case of C-TBL, indicates a cutoff frequency for VCF 11. Thus, at block 15-4, CPU 19 sets VCF element (2ST) of VCF 11 for filtering the first processed sound channel of ST-th string to the looked-up value as its cutoff frequency by way of D/A converter 21 and S/H circuit 22. As a result, in the operation of the single channel playback, the VCF element (2ST) of VCF 11 filters the first playback channel signal processed from the RAM 5 string data by way of elements 7 to 10 as a function of the string pitch extracted from ST-th string being played, thus providing the desired modification of its tone timbre.

In the case of dual channel playback mode (15-2), CPU 19 reads at block 15-5 a looked-up value from table C-TBL(M-1) using the extracted pitch PITCH(ST), and sets VCF element (2ST) to the looked-up value as the cutoff frequency of the first playback channel (15-6). Further, CPU 19 reads (15-7) another looked-up value from table C-TBL(M) using PITCH(ST), as shown in block 15-6 and sets VCF element (2ST+1) for filtering the second playback channel of ST-th string to the looked-up value as its cutoff frequency (15-8). In this way, the first and second playback channel signals are independently filtered to develop a rich composite sound. For the dual channel playback mode (M=2), table C-TBL(1) is used for providing the cutoff frequency of the first playback channel while table C-TBL(2) is used for providing the cutoff frequency of the second playback channel. In the case of the recording and dual channel playback mode (M=4), table C-TBL(3) is used for providing the cutoff frequency of the first playback channel while table C-TBL(4) is used for providing the cutoff frequency of the second playback channel.

Since the set VCF routine is executed during string vibrations in response to each change of pitch (see 13-20 in FIG. 13) as well as at the start of the string vibrations, dynamic and continuous control of tone timber can be realized while the string is being played, in particular when a player's finger slides along a string over the fingerboard.

Figure 16:
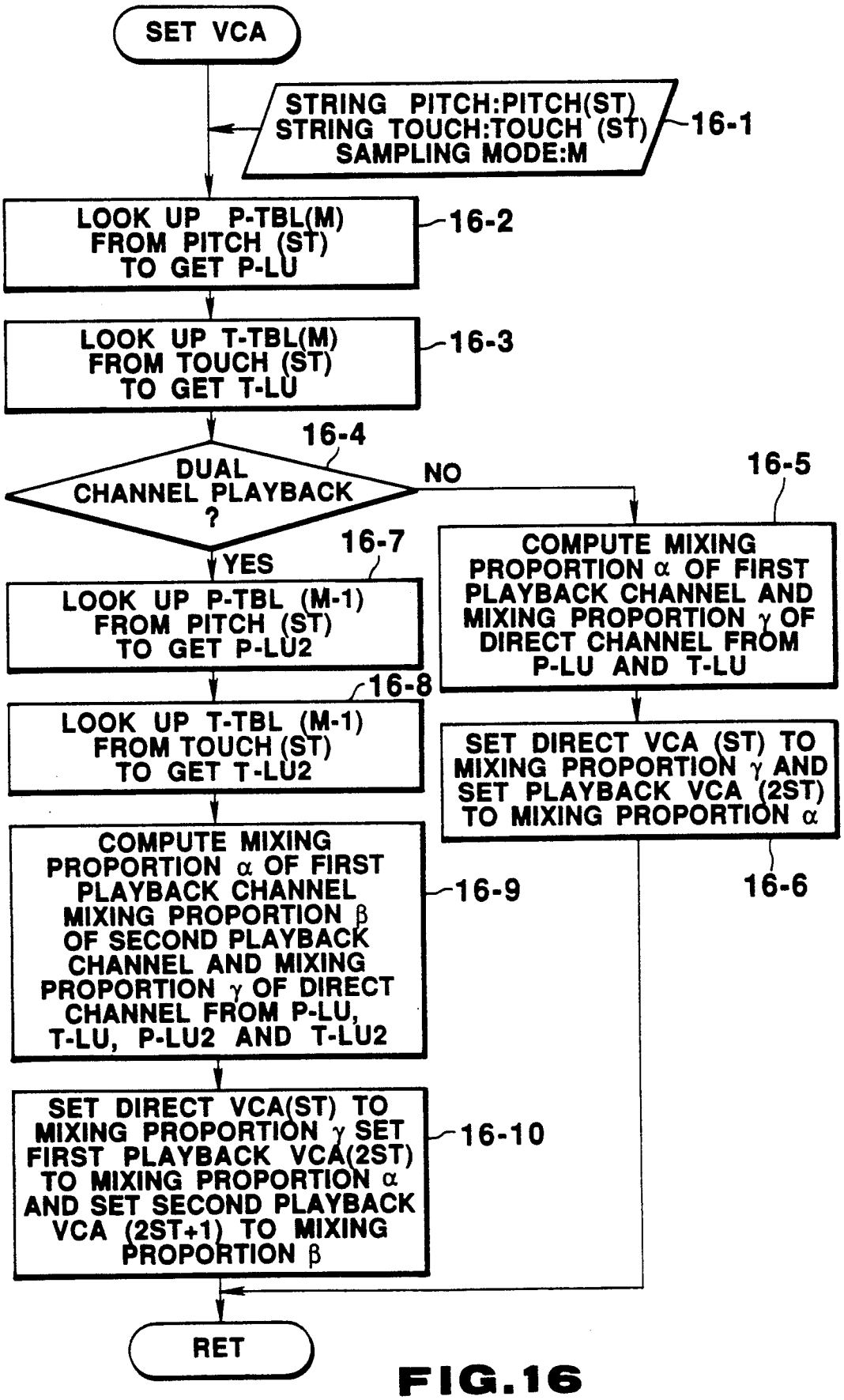
FIG. 16 is a flow diagram of set VCA executed by CPU for controlling sound mixing proportions.

FIG. 16 shows a detailed flow diagram of the set VCA routine 13-13, 13-21. The purpose of this routine is to control the mixing proportion of the direct sound and the processed sound as a function of the extracted string pitch and touch level. As indicated in block 16-1, the set VCA routine references the string pitch PITCH(ST) extracted from ST-th string being vibrated, string touch level TOUCH(ST) and selected sampling mode M. At block 16-2, using the extracted string pitch PITCH(ST), CPU 19 reads a looked-up value P-LU from pitch table P-TBL(M). Further CPU 19 reads (16-3) another looked-up value T-LU from touch table T-TBL(M) using the detected touch value TOUCH (ST). If the selected sampling mode is the single channel playback mode (16-4), CPU 19 computes the mixing proportion $\alpha$ of the (first) playback channel from the looked-up values p=LU and T-LU, and the mixing proportion $\gamma$ of the direct sound channel (16-5). Then CPU 19 sets VCA element (2ST) of VCA 13 for controlling the volume of the (first) playback channel signal of ST-th string and VCA element (ST) of VCA 12 for controlling the volume of the direct sound signal of ST-th string to the mixing proportions $\alpha$ and $\gamma$, respectively by way of D/A converter 21 and S/H circuit 22 (16-6). As a result the direct sound signal of ST-th string is amplitude-modulated by VCA 12 according to the mixing coefficient $\alpha$ which depends on the associated pitch and touch whereas the processed sound signal of ST-th string is amplitude-modulated by VCA 13 according to the mixing coefficient $\gamma$ which depends on the associated pitch and touch. In this way mixing proportion of the direct sound to processed sound is controlled depending on the pitch and touch. At block 16-5 the respective mixing proportions $\alpha$ and $\gamma$ of the processed sound and the direct sound may be given, for example:

$$\alpha = P-LU \times T-LU$$

$$\gamma = 1-\alpha$$

where $0 \leqq P-LU,\ T-LU \leqq 1$.

If the selected sampling mode is the dual channel playback mode (16-4), total of three sounds comprising one direct sound and two processed sounds are controlled in their mixing proportions. To this end, CPU 19 further reads a looked-up value P-LU2 from table P-TBL (M-1) and a looked-up value T-LU2 from table T-TBL (M-1) at blocks 16-7 and 16-8, respectively. Then at block 16-9, using the looked-up values P-LU, T-LU, P-LU2 and T-LU2, CPU 19 computes the respective mixing proportions $\alpha$, $\beta$, and $\gamma$ of first playback, second playback and direct sound signals by for example:

$$\alpha = \tfrac{1}{2}(P-LU2 \times T-LU2)$$

$$\beta = \tfrac{1}{2}(P-LU \times T-LU)$$

$$\gamma = (1-\alpha-\beta)$$

At block 16-10, CPU 19 sets VCA element (ST) of VCA 12 for controlling the volume of the direct sound signal of ST-th string, VCA element (2ST) of VCA 13 for controlling the volume of the first playback signal of ST-th string and VCA element (2ST+1) of VCA 13 for controlling the volume of the second playback signal to the mixing proportions $\gamma$, $\alpha$ and $\beta$, respectively.

In this manner, three components of the sound associated with playing of ST-th string i.e., direct sound signal, and first and second playback sound signals are controlled in their mixing proportions in various ways depending on the pitch and touch of the played string. Since the set VCA routine is executed even during the string vibration each time the string pitch is changed, the sound mixing proportions are controlled in very high degree of variety.

Figure 17:
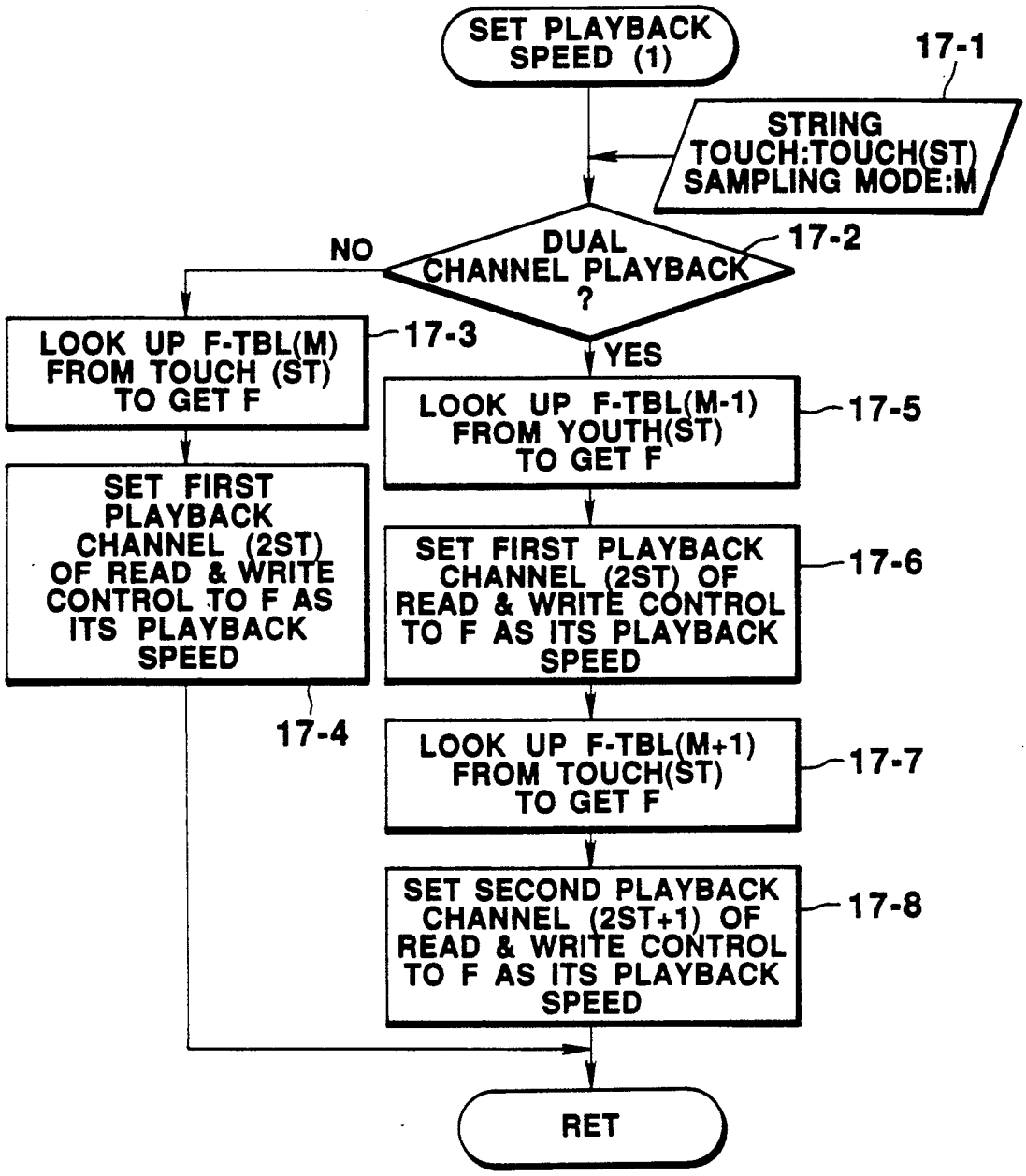
FIG. 17 is a flow diagram of set playback speed (1) executed by CPU in simultaneous recording and playback mode.

FIG. 17 shows a detailed flow diagram of the set playback speed (1) routine 13-11 executed in the recording and playback mode. The purpose of this routine is to modulate the processed sound pitch depending on the detected string touch so that the processed sound has a slightly different pitch from the direct sound pitch to produce a detuned sound effect. The set playback speed (1) routine references string touch TOUCH (ST) and selected sampling mode M as indicated in block 17-1. At block 17-2, CPU 19 tests the sampling mode flag M to determine whether M indicates either the single channel playback (M=1 or 3) or dual channel playback (M=2 or 4). In the case of the single channel playback mode, CPU reads (17-3) a looked-up value F from table F-TBL (M) using the detected string touch TOUCH (ST) and sends (17-4) the looked-up value F to the read and write control 6, as the playback speed of the single channel (corresponding to the first playback channel in the dual channel playback mode). This playback speed data is set into the read-address register 3-8 for the first playback channel of ST-th string. As a result, ST-th string data are read out from RAM 5 at the playback speed as a function of the string touch and outputted as a processed sound with a pitch corresponding to the playback speed.

In the case of the dual channel playback mode (17-2), CPU 19 reads (17-5) a looked-up value F from table F-TBL (M-1) using the detected string touch TOUCH (ST), and sends (17-6) the looked-up value F as the playback speed of the first playback channel to the read and write control 6 to load the data F into corresponding TDM channel of the read-address increment register 3-8. Further, CPU 19 reads (17-7) a looked-up value F from table F-TBL (M+1) using the string touch TOUCH (ST), and sends (17-7) the looked-up value F as the playback speed of the second playback channel to the read and write control to the read and write control 6 to thereby load the data F into corresponding channel of the read-address increment register 3-8. As a result the first playback sound pitch follows a string touch function value from table F-TBL (M−1) while the second playback sound pitch follows another string touch function value from table F-TBL (M+1). Therefore, a detune sound effect is produced among the direct sound, and first and second playback processed sounds depending on the string touch.

Figure 18:
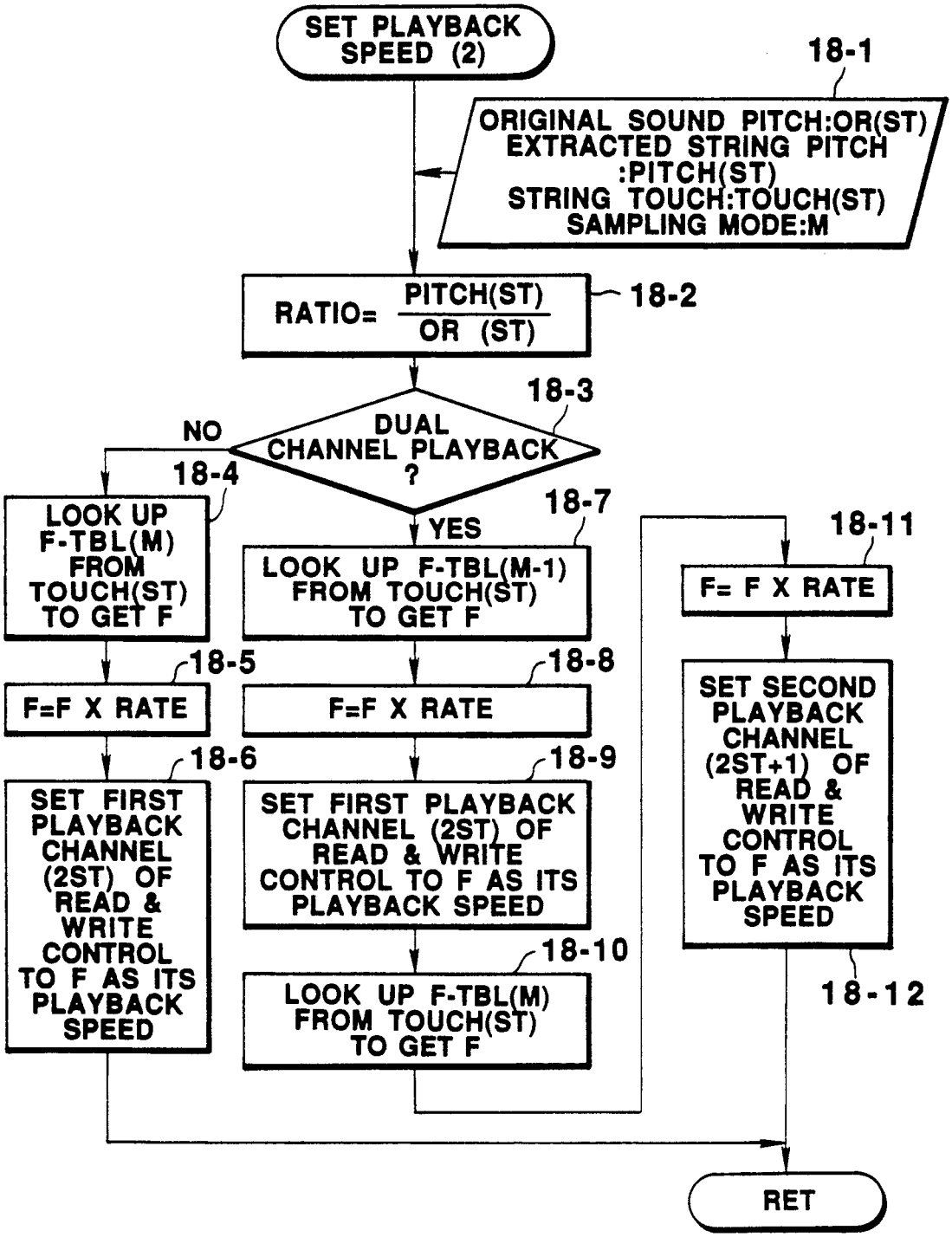
FIG. 18 is a flow diagram of set playback speed (2) executed by CPU in playback mode.

FIG. 18 shows a detailed flow diagram of the set playback speed (2) routine 13-10, 13-19 executed in the playback mode. The purpose of this routine is similar to that of the set playback speed (1) routine and is to produce a detuned sound effect between the processed sound and the direct sound. Since the set playback speed (1) routine is executed in the simultaneous recording and playback mode, the processed sound pitch will become the same as the direct sound pitch by simply setting the stepping speed of the playback pointer equal to that of the recording pointer. This relationship does not hold, however, for the set playback (2) routine because this routine is executed in the playback mode in which the string data previously recorded in RAM 5 are played back while the player is playing the instrument so that in general, the currently played string pitch will be unequal to the prerecorded string pitch. In view of this difference, the set playback speed (2) routine references the original sound pitch OR (ST) indicative of the string pitch already recorded in RAM 5 in addition to the string pitch PITCH (ST) and touch TOUCH (ST) extracted from the currently played string and the selected sampling mode M, as indicated in block 18-1. At block 18-2, CPU 19 computes the ratio of these two pitches by RATIO=PITCH (ST)/OR (ST).

In the case of the single channel playback mode (18-3), CPU 19 reads (18-4) a looked-up value as in the set playback (1) routine. This looked value is, however, multiplied by the pitch ratio RATIO to define the playback speed value of the processed sound (18-5) which is then sent to the read and write control 6 (18-6).

In the dual channel playback mode (18-3), looked-up values for first and second playback channels are respectively read out from tables (18-7, 18-10) and are similarly multiplied by the pitch ratio to define the playback speed for each playback channel (18-8, 18-11). The resultant playback speed data are sent to the read and write control 6 (18-9, 18-12).

In the course of the playback, each time the played string pitch changes, the set playback speed (2) routine is executed (13-19) so that a corresponding pitch change will appear in the playback sound.

In the flows of FIGS. 15 to 18, sound control parameters are obtained by referencing various look-up tables C-TBL, P-TBL, T-TBL and F-TBL for data conversion. If desired, such data conversion can be realized by arithmetic operations.

From the foregoing, the advantages and features of the embodiment have become apparent and include:

(A) A direct sound signal from string vibrations is combined with additional sound signal obtained by sampling and processing the direct sound signal. Therefore, the additional sound (processed sound) signal best fits the direct sound signal. The combined sound is full of variety and richer than the direct sound only.

(B) Various sampling functions such as recording, single channel playback, plural channel playback, simultaneous recording and single channel playback and simultaneous recording and plural channel playback are provided which are therefore applicable and selectable to various uses and modes of the instrument.

(C) Characteristics of the processed sound can be controlled in various ways.

(D) Further, characteristics of the processed sound can be dynamically controlled in accordance with the player's string operation.

(E) For example, the playback pitch of the processed sound can be made different from the pitch of the direct sound by the desired amount depending on the amplitude of string vibrations to thereby produce a detuned effect between the processed sound and the direct sound.

(F) Pitch of the playback processed sound can be modulated depending on the touch level (e.g. plucking or bowing strength) of string vibrations.

(G) Mixing proportions of the direct sound and the processed sound can be controlled depending on the pitch and amplitude level of string vibrations.

(H) Tone timbre of the processed sound can be controlled depending on the level of string vibrations.

(I) The simultaneous recording and playback function is also applicable to other sampling musical instrument. The dual or plural channel playback function is useful for producing a rich processed sound.

(J) In the simultaneous recording and playback mode, playback operation can continue without any interruption even when the sound is played back at a different pitch from the recorded pitch. In particular, a noise free processed sound can be obtained with a different pitch from the recorded sound pitch by detecting an approaching event between the recording address pointer and the first playback address pointer, forming additional second playback address pointer and crossfading the two playback signals associated with the first and second playback address pointers.

This concludes the detailed description. However, various modifications and alternations will be obvious to a person of ordinary skill in the art without departing from the scope of the invention.

In the embodiment, up to two channels per string are played back. An increased number of channels may be played back simultaneously by modifying the read and write control 6.

In the embodiment, the string data RAM 5 records direct string sound data with one recorded channel per string. If desired, the string data RAM 5 may store a larger amount of string data. In a modification, the string data RAM 5 may be recorded with string data from each string or from respective vibration picks ups located at different positions of the strings (e.g., rear pick ups P1-P6, center pick ups P7-P12, front pick ups P13-P18). When playing back, the user selects particular string data recorded from a particular string or pick-up. In another modification, the direct string sound path in FIG. 1B is connected to a first plurality of pick ups, e.g., rear pick-ups P1-P6 near the bridge so that signals from the rear pick ups are outputted as direct sounds whereas the sampling and recording path is connected to a second plurality of pick ups, e.g., from front pick ups P13-P18 away from the bridge so that the string data recorded from the front pick ups are played back and outputted as processed sounds. This arrangement serves to further enrich the total sound because picked-up signal may have different waveforms depending on the locations of the pick ups.

In the embodiment, the direct string sound signal from the pick up is outputted through the direct sound path without any substantial delay whereas the processed sound signal is somewhat delayed because its playback will not start until the first pitch of the string vibrations has been established, which causes CPU 19 to command the read and write control 6 to start the playback operation. The time required for establishment of the pitch is indefinite. In one solution to this problem, a delay circuit may be connected in the direct sound path. CPU 19 or the like measures the time from the start of string vibrations to the establishment of the first pitch and selects a suitable tap of the delay circuit corresponding to the measured time to output the direct sound from the tap while at the same commanding the read and write control 6 to start the playback operation. In another and preferred solution, the recording/-playback path including the string data RAM 5 is also used for the direct sound path for passing the direct sound. Specifically, in the recording and playback mode in which a plurality of channels are played back, one of the plurality of playback channels is selected as the direct sound channel. For example, in the recording and dual channel playback mode, the first playback channel is assigned as the direct sound channel. By playing back such direct sound channel with the playback pointer stepping rate (read-address incremental value) of "1" equal to the recording pointer stepping rate, the system can provide synchronization or a controlled time difference between the direct sound output from the first playback channel and the processed sound output from the second playback channel.

In the embodiment, the string as source of the played back string data from RAM 5 is made identical with the string that triggers the playback operation and is manually played during the playback operation. This is not restrictive, however. There may be provided an assigning function which selects one or more recorded channels of string data in RAM 5 for each string to be played. In the playback mode, the recorded string data are played back as processed sound according to the assigning function, thus enriching their timbres.

In the embodiment, the playback sound pitch is controlled by varying the stepping rate of the playback address pointer of the string data RAM 5. In place of or in combination with this, the playback sampling frequency may be changed to control the playback sound pitch.

VCF 11 for processing timbre of the playback sound may be replaced by a digital filter.

The manner of controlling the instrument by the playing operation is not restricted to the embodiment. For example, bending operation on the strings or vibrate arm operations may be measured to control characteristics of the processed sound or direct sound.

What is claimed is:

1. An electronic stringed instrument, comprising:

a plurality of strings;

a plurality of pick up means provided for respective ones of said plurality of strings, each of said pick up means converting mechanical string vibrations having a time varying amplitude into a corresponding analog picked-up signal;

analog-to-digital converter means for successively converting respective analog picked-up signals from said plurality of pick up means to corresponding digital picked-up signals in a multiplexed operation;

storing means for successively and time divisionally storing said respective digital picked-up signals from said analog to digital converter means;

reading means for successively and time divisionally reading stored digital picked-up signals from said storing means in synchronism with the storing operation of said storing means;

digital-to-analog converter means for successively converting read-out digital picked-up signals from said reading means to analog audio signals;

sound output means for outputting analog audio signals from said digital-to-analog converter means as sounds;

amplitude level detecting means for successively detecting respective amplitude levels of said analog picked-up signals from said plurality of pick up means and for finding a respective maximum amplitude level of said analog picked-up signals in said detected amplitude levels to thereby obtain numerical data for each of the strings corresponding to said maximum amplitude level and indicative of strength of said string vibrations; and control means for controlling respective characteristics of the sounds to be outputted by said sound output means for each of the strings, based on the corresponding numerical data from said amplitude level detecting means.

2. The electronic stringed instrument of claim 1 further comprising interpolator means for interpolating a required digital picked-up signal between read-out digital picked-up signal samples from said reading means and for supplying said required digital picked-up signal to said digital-to-analog converter means.

3. The electronic stringed instrument of claim 1 wherein said control means controls envelope, tone timbre, pitch or volume of said sounds to be outputted by said sound output means based on said respective numerical data from said amplitude level detecting means.

4. An electronic stringed instrument, comprising:

a plurality of strings;

a plurality of pick up means provided for respective ones of said plurality of strings, each of said pick up means converting mechanical string vibrations having an unknown and time-variable pitch into a corresponding analog picked-up signal;

analog-to-digital converter means for successively converting respective analog picked-up signals from said plurality of pick up means to corresponding digital picked-up signals in a multiplexed operation;

storing means for successively and time divisionally storing said respective digital picked-up signals from said analog-to-digital converter means;

reading means for successively and time divisionally reading stored digital picked-up signals from said storing means in synchronism with the storing operation of said storing means;

digital-to-analog converter means for successively converting read-out digital picked-up signals from said reading means to analog audio signals;

sound output means for outputting said analog audio signals from said digital-to-analog converter means as sounds;

pitch extracting and tracking means for extracting and tracking respective pitches of said analog picked-up signal from said plurality of pick up means by successively measuring fundamental periods of said respective analog picked-up signals to thereby obtain numerical data for each of the strings identifying a current pitch of said string vibrations;

pitch change detecting means for detecting respective pitch changes of said string vibrations by comparing respective new and old values of said numerical data from said pitch extracting and tracking means; and control means responsive to said pitch change detecting means for controlling respective characteristics of the sounds to be outputted by said sound output means for each of the strings based on a new value of said numerical data from said pitch extracting and tracking means each time when an individual pitch change of said string vibrations is detected.

5. The electronic stringed instrument of claim 4 further comprising interpolator means for interpolating a required digital picked-up signal between read-out digital picked-up signal samples from said reading means and for supplying said required digital picked-up signal to said digital-to-analog converter means.

6. The electronic stringed instrument of claim 1 wherein said control means controls envelope, tone timbre, pitch or volume of said sounds to be outputted by said sound output means based on said respective numerical data from said pitch extracting means.

7. An electronic musical instrument, comprising:

a plurality of strings:

a plurality of pick up means provided for respective ones of said plurality of strings, each of said pick up means converting mechanical string vibrations having a time varying amplitude into a corresponding analog input signal;

analog-to-digital converter means for successively converting respective analog input signals from said plurality of pick up means to corresponding digital signals;

storing means for successively storing said digital signals from said analog-to-digital converter means;

reading means for successively reading stored digital signals from said storing means;

digital-to-analog converter means for successively converting read-out digital signals from said reading means to analog audio signals;

sound output means for outputting said analog audio signals from said digital-to-analog converter means as sounds;

simultaneous recording and playback means for controlling operation timings of said analog-to-digital converter means, said storing means, said reading means and said digital-to-analog converter means in accordance with time-division-multiplexing such that a recording operation of said analog-to-digital converter means and said storing means is performed simultaneously with playback operation of said reading means, said digital-to-analog converter means and said sound output means;

amplitude level detecting means for successively detecting respective amplitude levels of said analog input signals and for finding respective maximum amplitude levels in said detected amplitude levels to thereby obtain numerical data for each of the strings corresponding to said maximum amplitude level; and control means for controlling respective characteristics of the sounds to be outputted by said sound output means for each of the strings based on the corresponding numerical data from said amplitude level detecting means.

8. An electronic musical instrument, comprising:

a plurality of strings;

a plurality of pick up means provided for respective ones of said plurality of strings, each of said plurality of pick up means converting mechanical string vibrations having an unknown and time-variable pitch into a corresponding analog input signal;

analog-to-digital converter means for successively converting respective analog input signals from said plurality of pick up means to corresponding digital signals;

storing means for successively storing said digital signals from said analog-to-digital converter means;

reading means for successively reading stored digital signals from said storing means;

digital-to-analog converter means for successively converting read-out digital signals from said reading means to analog audio signals;

sound output means for outputting said analog audio signals from said digital-to-analog converter means as sounds;

simultaneous recording and playback means for controlling operation timings of said analog-to-digital converter means, said storing means, said reading means and said digital-to-analog converter means in accordance with time-division-multiplexing such that recording operation of said analog-to-digital converter means and said storing means is performed simultaneously with playback operation of said reading means, said digital-to-analog converter means and said sound output means;

pitch extracting and tracking means for extracting and tracking respective pitches of said analog input signals by successively measuring fundamental periods of said respective analog input signals to thereby obtain numerical data for each of the plurality of strings identifying a current pitch of said analog input signal;

pitch change detecting means for detecting respective pitch changes of said analog input signal by comparing respective new and old values of said numerical data from said pitch extracting and tracking means; and control means responsive to said pitch change means for controlling respective characteristics of the sounds to be outputted by said sound output means for each of the strings based on a new value of said numerical data from said pitch extracting means and tracking each time when an individual pitch change of said analog input signal is detected.

9. An electronic musical instrument, comprising:

recording means for sampling and digitally recording a plurality of analog audio input signals on a storage medium in a time multiplexed operation; and sound-effects-controllable playback means for digitally reading data from said storage medium and for playing back sound generating signals in synchronism with the recording operation of said recording means while controlling sound-effects of said sound generating signals based on corresponding parameters of said analog audio input signals;

wherein said recording means comprises:

input means for inputting said plurality of analog audio input signals, said input means including a plurality of strings and a plurality of pick up means provided for respective strings, each of said pick up means converting mechanical string vibrations into a corresponding analog audio input signal;

analog-to-digital converter means for successively converting respective analog audio input signals from said input means to corresponding digital signals; and writing means for successively and time divisionally writing said respective digital signals into said storage medium in a predetermined direction; and wherein said sound-effects-controllable playback means comprises:

parameter deriving means coupled to said input means for deriving said parameter of said analog audio input signals;

reading means for successively reading a stored digital signal from said storage medium in the same direction as said predetermined direction to thereby provide said sound generating signals;

processing means for processing said sound generating signals; and sound-effects controlling means for controlling said processing means based on said parameter of said analog audio input signals from said parameter deriving means such that sound-effects of said sound generating signals vary as a function of corresponding parameters of said analog audio input signals for each of the plurality of strings.

10. An electronic musical instrument, comprising:

recording means for sampling and digitally recording a plurality of analog audio input signals on a storage medium in a time multiplexed operation; and sound-effects-controllable playback means for digitally reading data from said storage medium and for playing back sound generating signals in synchronism with the recording operation of said recording means while controlling sound-effects of said sound generating signals based on corresponding parameters of said analog audio input signals;

wherein said recording means comprises:

input means for inputting said plurality of analog audio input signals, said input means including a plurality of strings and a plurality of pick up means provided for respective strings, each converting mechanical string vibrations into a corresponding analog audio input signal;

analog-to-digital converter means for successively converting respective analog audio input signals from said input means to corresponding digital signals; and writing means for successively and time divisionally writing said respective digital signals into said storage medium in a predetermined direction;

wherein said sound-effects-controllable playback means comprises:

parameter deriving means coupled to said input means for deriving said parameter of said analog audio input signals;

multiplexed playback means operative on a time division multiplexed basis for providing a plurality of playback channels corresponding to the plurality of strings in which each channel includes:

(a) reading means for successively reading a stored digital signal from said storage medium in the same direction as said predetermined direction to thereby provide a channel playback signal as a component of said sound generating signal;

(b) processing means for processing said channel playback signal; and (c) sound-effects controlling means for controlling said processing means based on said parameter of said analog audio input signal from said parameter deriving means in a manner unique to each of said plurality of playback channels whereby said plurality of playback channels produce a plurality of channel playback signals, sound effects of which are different from each other.

11. An electronic musical instrument, comprising:

recording means for sampling and digitally recording a plurality of analog audio input signals on a storage medium in a time multiplexed operation; and sound-effects-controllable playback means for digitally reading data from said storage medium and for playing back sound generating signals in synchronism with the recording operation of said recording means while controlling sound-effects of said sound generating signals based on corresponding parameters of said analog audio input signals;

wherein said recording means comprises:

input means for inputting said plurality of analog audio input signals, said input means including a plurality of strings and a plurality of pick up means provided for respective strings, each of said pick up means converting mechanical string vibrations into a corresponding analog audio input signal;

analog-to-digital converter means for successively converting respective analog audio input signals from said input means to corresponding digital signals; and writing means for successively and time divisionally writing said respective digital signals into said storage medium in a predetermined direction; and wherein said sound-effects-controllable playback means comprises:

parameter deriving means coupled to said input means for deriving said parameter of said analog audio input signals;

reading means for successively reading stored digital signals from said storage medium in the same direction as said predetermined direction to thereby provide said sound generating signals; and reading velocity control means for controlling velocity of reading by said reading means as a function of said parameter of said analog audio input signals such that said sound generating signals are played back with modified pitches different from those of said analog audio input signals to achieve said sound effects for each of the plurality of strings.

* * * * *

UNITED STATES PATENT AND TRADEMARK OFFICE

CERTIFICATE OF CORRECTION

PATENT NO. 5,308,916
DATED May 3, 1994
INVENTOR(S) MURATA et al

It is certified that error appears in the above-indentified patent and that said Letters Patent is hereby corrected as shown below:

Column 24, line 62 (claim 6),

"claim 1" should be --claim 4--.

Signed and Sealed this

Seventh Day of November, 1995

*Attest:*

*Attesting Officer*

BRUCE LEHMAN

*Commissioner of Patents and Trademarks*